US012286141B2

(12) United States Patent
Schuller et al.

(10) Patent No.: US 12,286,141 B2
(45) Date of Patent: Apr. 29, 2025

(54) HOPPER RAILROAD CAR HAVING TOP HATCH COVER ASSEMBLY

(71) Applicant: Gunderson LLC, Portland, OR (US)

(72) Inventors: Daniel J. Schuller, North Richland Hills, TX (US); Jordan Paul Liske, Yankton, SD (US); Steven James Knight, Mission Hill, SD (US); Peter L. Jones, Southlake, TX (US)

(73) Assignee: Gunderson LLC, Lake Oswego, OR (US)

( * ) Notice: Subject to any disclaimer, the term of this patent is extended or adjusted under 35 U.S.C. 154(b) by 871 days.

(21) Appl. No.: 17/498,217

(22) Filed: Oct. 11, 2021

(65) Prior Publication Data

US 2023/0113865 A1 Apr. 13, 2023

(51) Int. Cl.

| | |
|---|---|
| ***B61D 7/14*** | (2006.01) |
| ***B61D 7/00*** | (2006.01) |
| ***B61D 17/16*** | (2006.01) |
| ***B61D 39/00*** | (2006.01) |
| ***B65D 90/00*** | (2006.01) |
| ***B65D 90/10*** | (2006.01) |

(52) U.S. Cl.

CPC ..... *B61D 7/14* (2013.01); *B61D 5/08* (2013.01); *B61D 7/00* (2013.01); *B61D 17/16* (2013.01); *B61D 39/006* (2013.01); *B65D 90/10* (2013.01)

(58) Field of Classification Search

CPC ..... B61D 7/14; B61D 7/00; B61D 39/006; B61D 17/16; B61D 5/08; B65D 90/10

USPC ..... 105/247

See application file for complete search history.

(56) References Cited

U.S. PATENT DOCUMENTS

| | | | | |
|---|---|---|---|---|
| 1,776,168 | A * | 9/1930 | Sweeley | B61D 27/0081 105/377.07 |
| 2,239,033 | A | 4/1941 | Cartmill | |
| 3,190,238 | A | 6/1965 | Carney et al. | |
| 3,224,491 | A | 12/1965 | Wallace | |
| 3,348,602 | A | 10/1967 | Bertil | |
| 3,476,042 | A * | 11/1969 | Dugge | B61D 39/00 105/377.06 |
| 3,707,919 | A | 1/1973 | Adler | |
| 3,760,743 | A * | 9/1973 | Walk | B61D 5/08 220/314 |
| 3,796,168 | A | 3/1974 | Zeller | |
| 4,040,363 | A | 8/1977 | Walk et al. | |
| 4,239,008 | A | 12/1980 | Conlon | |
| 4,245,565 | A | 1/1981 | Stark et al. | |

(Continued)

FOREIGN PATENT DOCUMENTS

| | | | |
|---|---|---|---|
| BR | 102014028426 | A2 | 9/2016 |
| DE | 3721146 | A1 | 1/1989 |

(Continued)

OTHER PUBLICATIONS

"Extended European Search Report", corresponding European Patent Application No. 22196293.9, Mar. 2, 2023.

*Primary Examiner* — S. Joseph Morano
*Assistant Examiner* — James William Jones
(74) *Attorney, Agent, or Firm* — Neal, Gerber & Eisenberg LLP

(57) ABSTRACT

A hopper railroad car top hatch cover assembly including a hatch cover and a hatch cover securer configured to secure the hatch cover in a closed position engaging a coaming of the hopper railroad car.

20 Claims, 22 Drawing Sheets

(56) References Cited

U.S. PATENT DOCUMENTS

| | | | | |
|---|---|---|---|---|
| 4,248,160 | A | 2/1981 | Carney et al. | |
| 4,376,542 | A | 3/1983 | Hennessy | |
| 4,452,150 | A | 6/1984 | Dominguez | |
| 4,635,979 | A * | 1/1987 | Blume | B65D 90/10 220/314 |
| 4,638,743 | A | 1/1987 | Loomis | |
| 4,840,126 | A | 6/1989 | Kleykamp | |
| 5,311,824 | A * | 5/1994 | Sauer | E05D 15/505 105/377.01 |
| 5,438,935 | A * | 8/1995 | Seitz | F16J 13/18 114/203 |
| 5,785,362 | A | 7/1998 | Nadherny | |
| 6,293,051 | B1 | 9/2001 | Matye | |
| 6,827,025 | B2 | 12/2004 | Gaydos et al. | |
| 7,823,515 | B2 | 11/2010 | Schaefer et al. | |
| 8,056,486 | B2 | 11/2011 | Haymond et al. | |
| 8,631,746 | B2 | 1/2014 | Knight et al. | |
| 8,701,565 | B2 * | 4/2014 | Creighton | B61D 7/00 105/377.01 |
| 8,826,827 | B1 | 9/2014 | Dimmer et al. | |
| 9,783,212 | B2 | 10/2017 | Gibney et al. | |
| 10,035,521 | B2 | 7/2018 | Williams | |
| 2008/0029011 | A1 | 2/2008 | Czarnowski et al. | |
| 2010/0258032 | A1 | 10/2010 | Haymond et al. | |
| 2010/0307374 | A1 | 12/2010 | Kalal | |
| 2012/0048140 | A1 | 3/2012 | Dial et al. | |
| 2012/0152146 | A1 | 6/2012 | Blankenship | |
| 2013/0020829 | A1 | 1/2013 | Smith et al. | |
| 2017/0225694 | A1 | 8/2017 | Sandheinrich et al. | |
| 2019/0112867 | A1 | 4/2019 | Warren | |
| 2019/0161096 | A1 | 5/2019 | Warren | |
| 2021/0046955 | A1 | 2/2021 | Jones et al. | |
| 2021/0213981 | A1 | 7/2021 | Jones et al. | |
| 2022/0063682 | A1 | 3/2022 | Jones et al. | |

FOREIGN PATENT DOCUMENTS

| | | | | |
|---|---|---|---|---|
| KR | 20130142672 | A * | 12/2013 | |
| SK | 35495 | A3 * | 10/1995 | |
| WO | WO-2021155075 | A1 * | 8/2021 | B61D 39/006 |

* cited by examiner

HOPPER RAILROAD CAR HAVING TOP HATCH COVER ASSEMBLY

BACKGROUND

The railroad industry employs a variety of different railroad cars for transporting different materials. For example, various known railroad cars often carry bulk materials such as grain, and are sometimes call "hopper railroad cars." Known hopper railroad cars often include one or more openable top hatches that seal the top opening(s) of the hopper railroad car (when the hopper railroad car is not being loaded) to protect the materials in the hopper railroad car from the elements and other external sources. Various known hopper railroad cars also include one or more discharge chutes at the bottom of the hopper railroad car for unloading the materials from the hopper railroad car. Various known hopper railroad cars include one or more internal walls that provide structure to the hopper railroad car and that direct the materials in the hopper railroad car toward the discharge chute(s). To load various known hopper railroad cars, the hopper railroad car is positioned underneath a material loading assembly, and the top hatch(es) are opened. Opening the top hatch(es) often require(s) specialized machinery and/or a worker to be physically present on the top of the hopper railroad car to open the top hatch(es).

There is a continuing need to provide improved hopper railroad cars, such as hopper railroad cars that have one or more improved top hatch assemblies that improve the material loading process.

SUMMARY

Various embodiments of the present disclosure provide an improved top hatch cover assembly for a hopper railroad car. Various embodiments of the present disclosure provide a hopper railroad car having an improved top hatch cover assembly. In various example embodiments of the present disclosure, the top hatch cover assembly includes a hatch cover, a hatch cover securer configured to co-act with and to secure the hatch cover in a closed position, and first and second multi-action actuators operably connected to the hatch cover and the hatch cover securer to operate both the hatch cover and the hatch cover securer. The first and second multi-action actuators are configured to unlock and lock the hatch cover securer. The first and second multi-action actuators are also configured to open and close the hatch cover securer when the hatch cover securer is unlocked. Various embodiments of the present disclosure also include a plurality of icebreaker assemblies configured to engage the hatch cover during the process of unlocking the hatch cover securer, to overcome the effects of any ice buildup on the movable hatch that causes the movable hatch to be temporarily stuck in the closed position.

Other objects, features, and advantages of the present disclosure will be apparent from the following detailed disclosure, taken in conjunction with the accompanying sheets of drawings, wherein like reference numerals refer to like parts.

Figure 1:
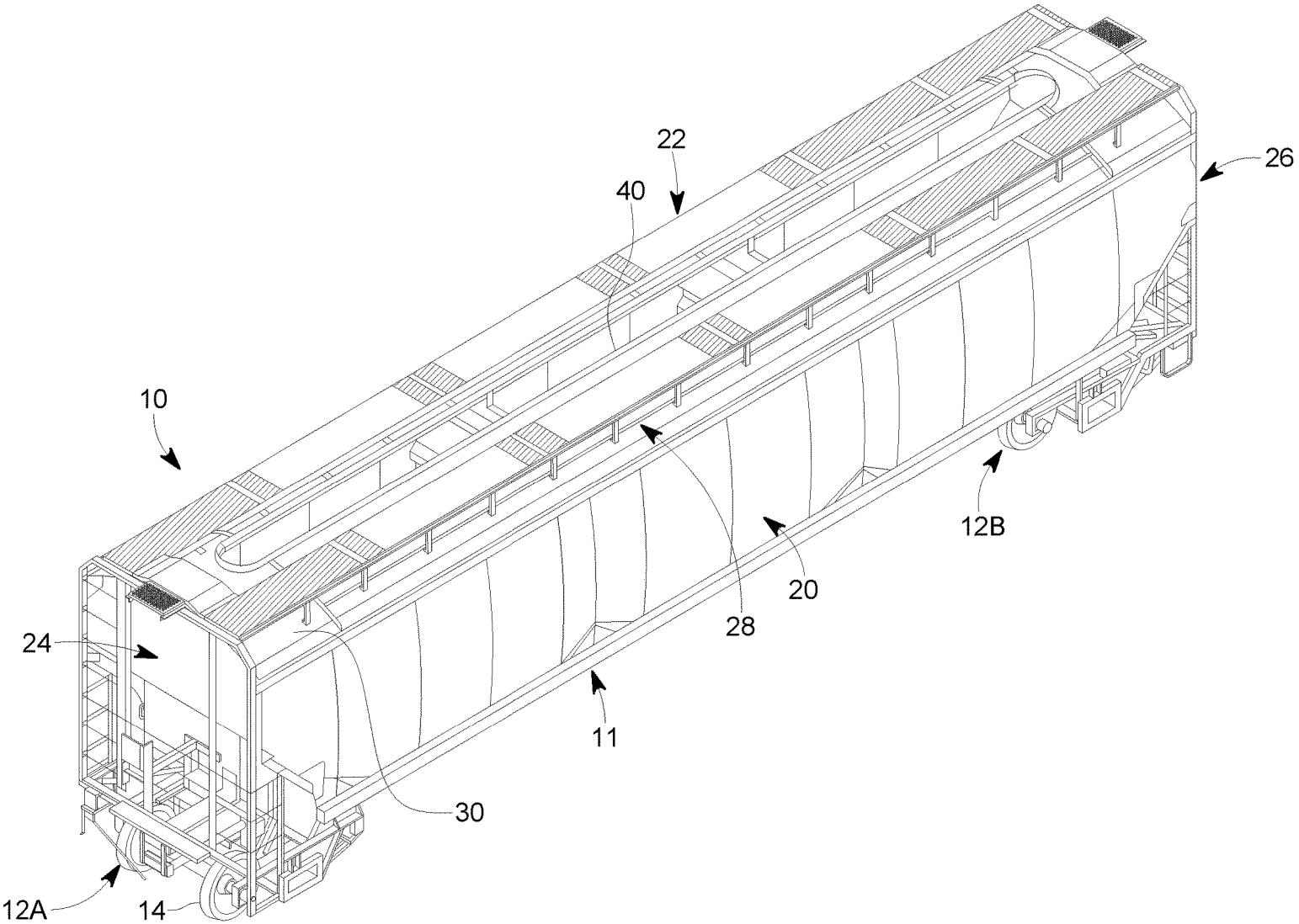
FIG. 1 is a top perspective view of a hopper railroad car of the present disclosure that is configured to transport a variety of bulk materials, shown without the top hatch cover assembly of the present disclosure and shown with running boards connected to the roof.
Figure 2:
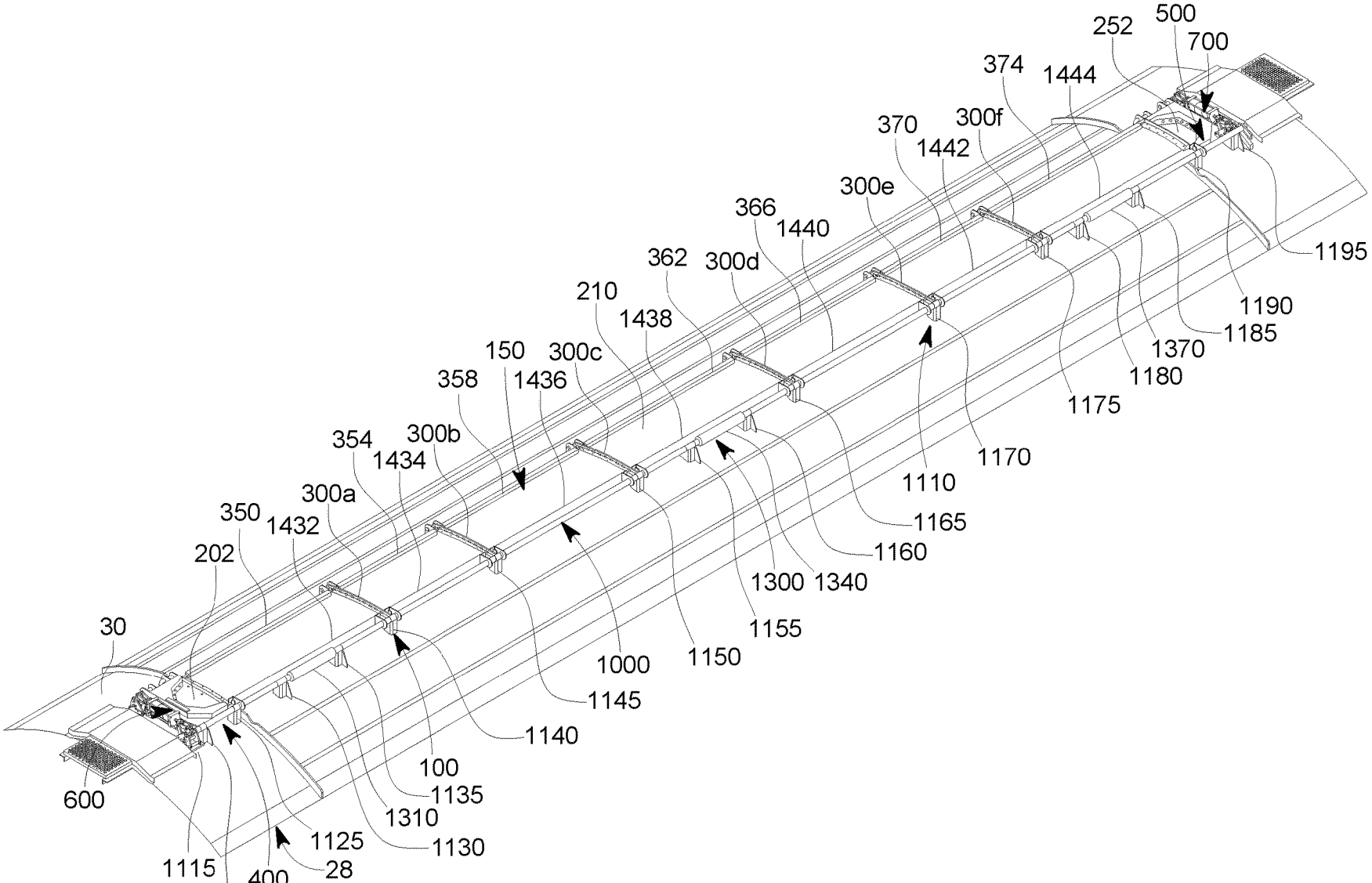
FIG. 2 is an enlarged top perspective view of the roof of an example hopper railroad car, showing a top hatch cover assembly of one example embodiment of the present disclosure connected to the roof of the hopper railroad car of FIG. 1 and shown in the closed position.
Figure 3:
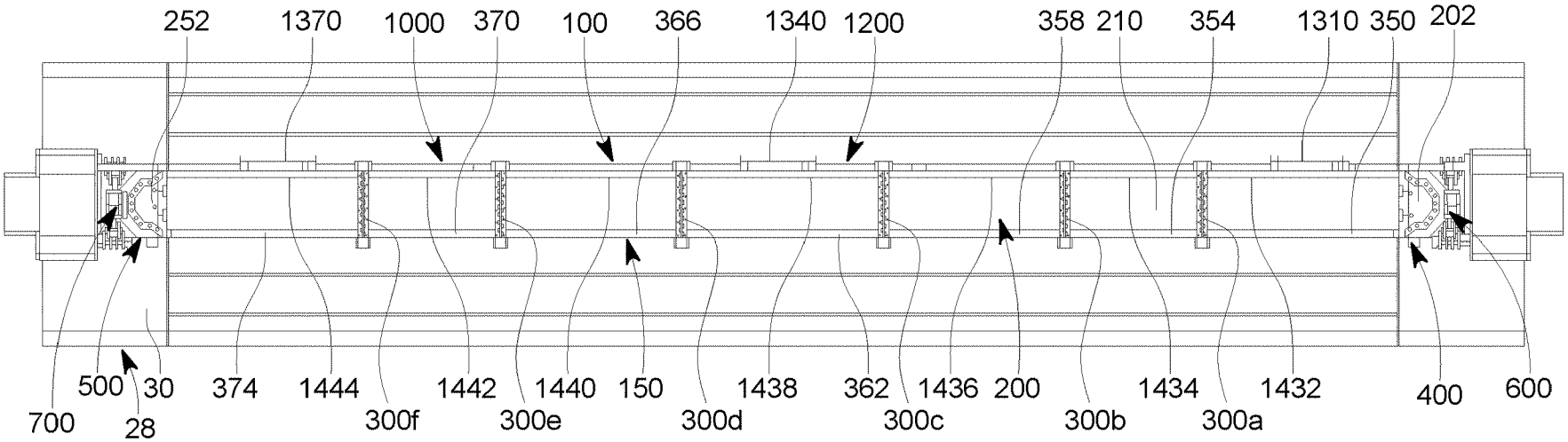
FIG. 3 is an enlarged top view of the roof of the hopper railroad car of FIG. 2, and the top hatch cover assembly of FIG. 2 shown connected to the roof of the hopper railroad car of FIG. 1 and shown in the closed position.

1, and the second end of the top hatch cover assembly of FIG. 2 shown connected to the second end of the roof of the hopper railroad car of FIG. 1 and shown in a partially open position.

Figure 15:
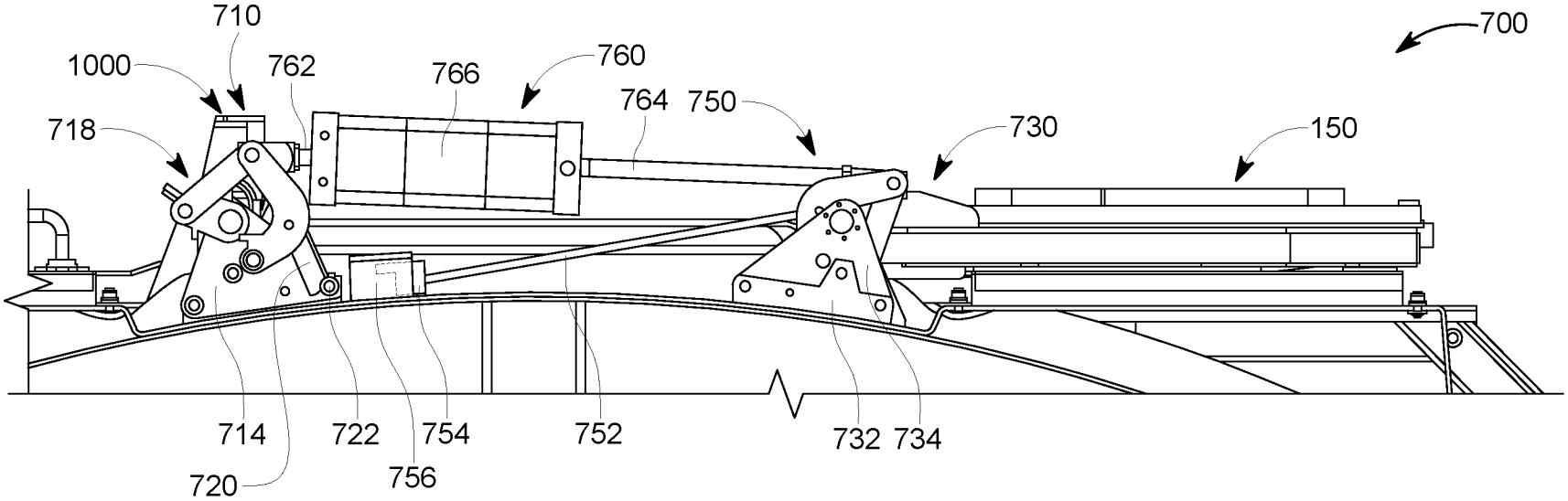

FIG. 15 is an enlarged fragmentary end view of the second end of the roof of the example hopper railroad car of FIG. 1, and the second end of the top hatch cover assembly of FIG. 2 shown connected to the second end of the roof of the hopper railroad car of FIG. 1 and shown in a fully open position.

Figure 16:
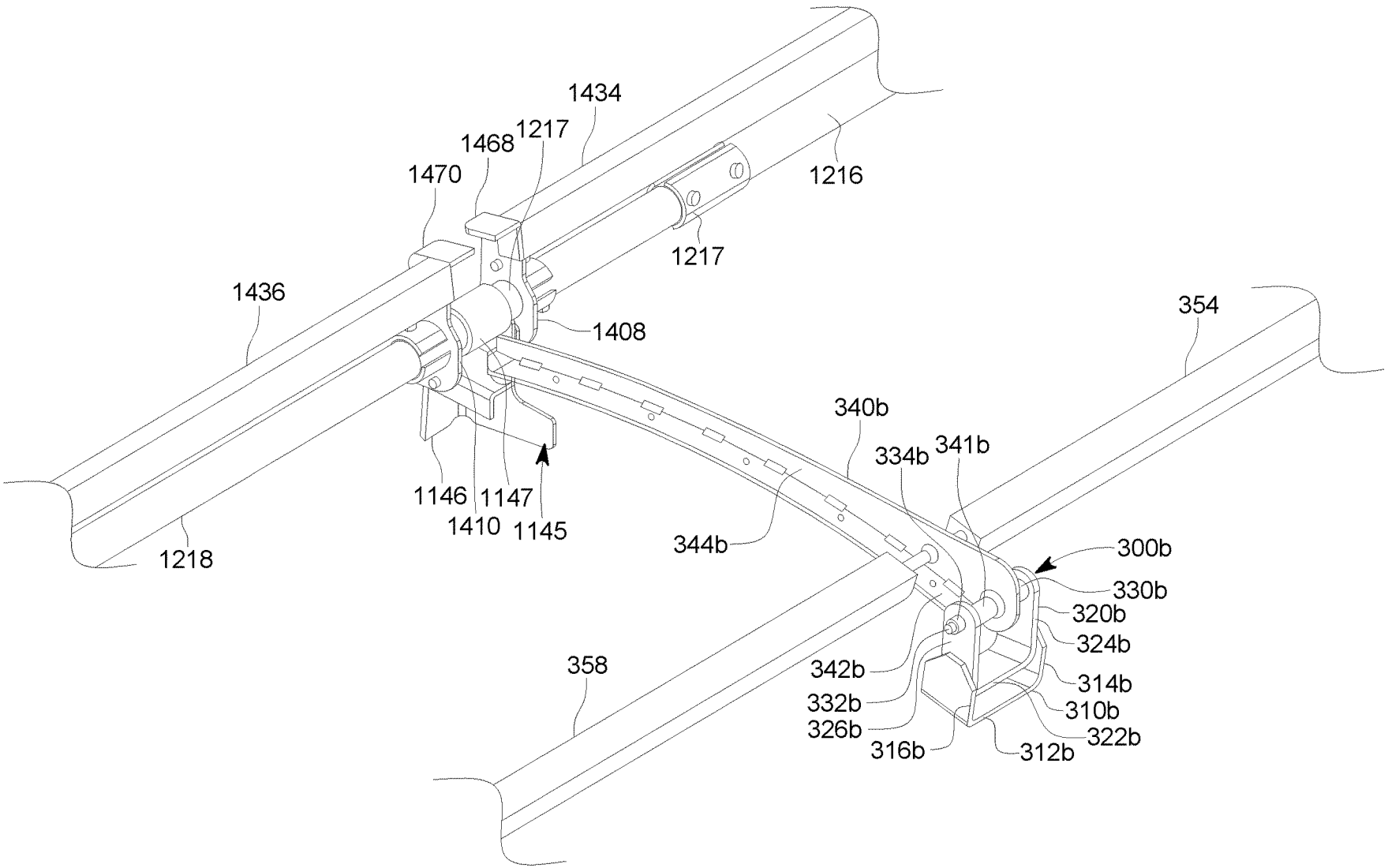

FIG. 16 is an enlarged fragmentary top perspective view of certain parts (including one of the central hinges) of the hatch cover and of certain parts (including one of the hatch cover engagers) of the hatch cover securer of the hatch cover assembly of FIG. 2.

Figure 17:
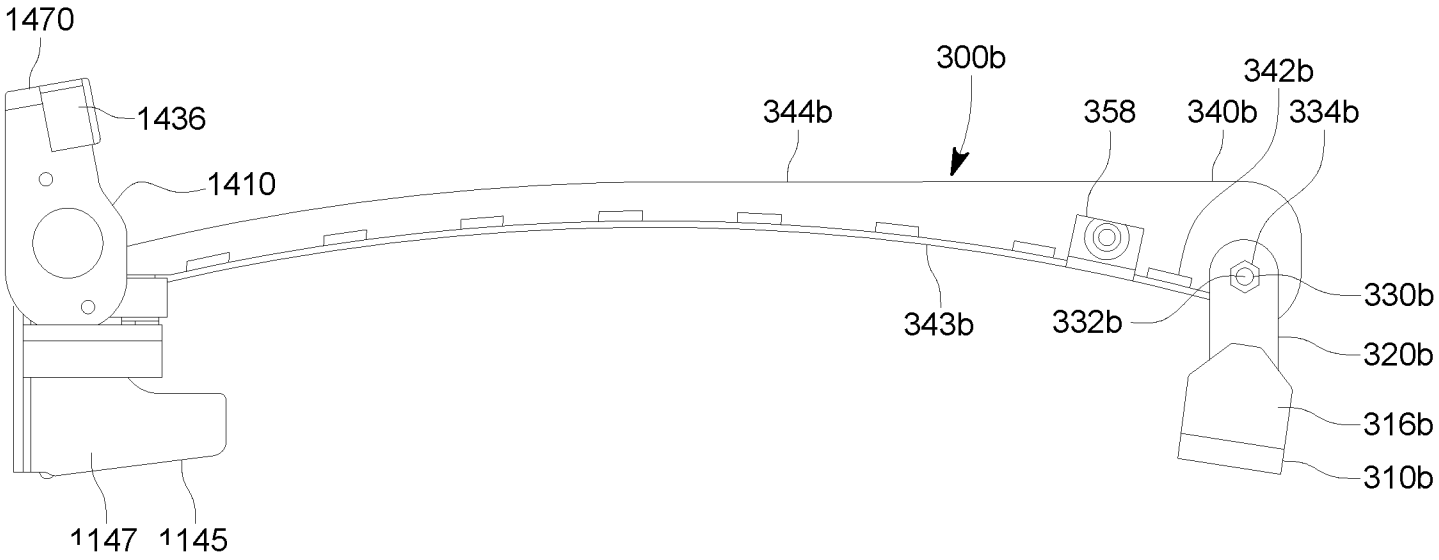

FIG. 17 is an enlarged end view of certain parts (including one of the central hinges) of the hatch cover and of certain parts (including one of the hatch cover engagers) of the hatch cover securer of the hatch cover assembly of FIG. 2.

Figure 18:
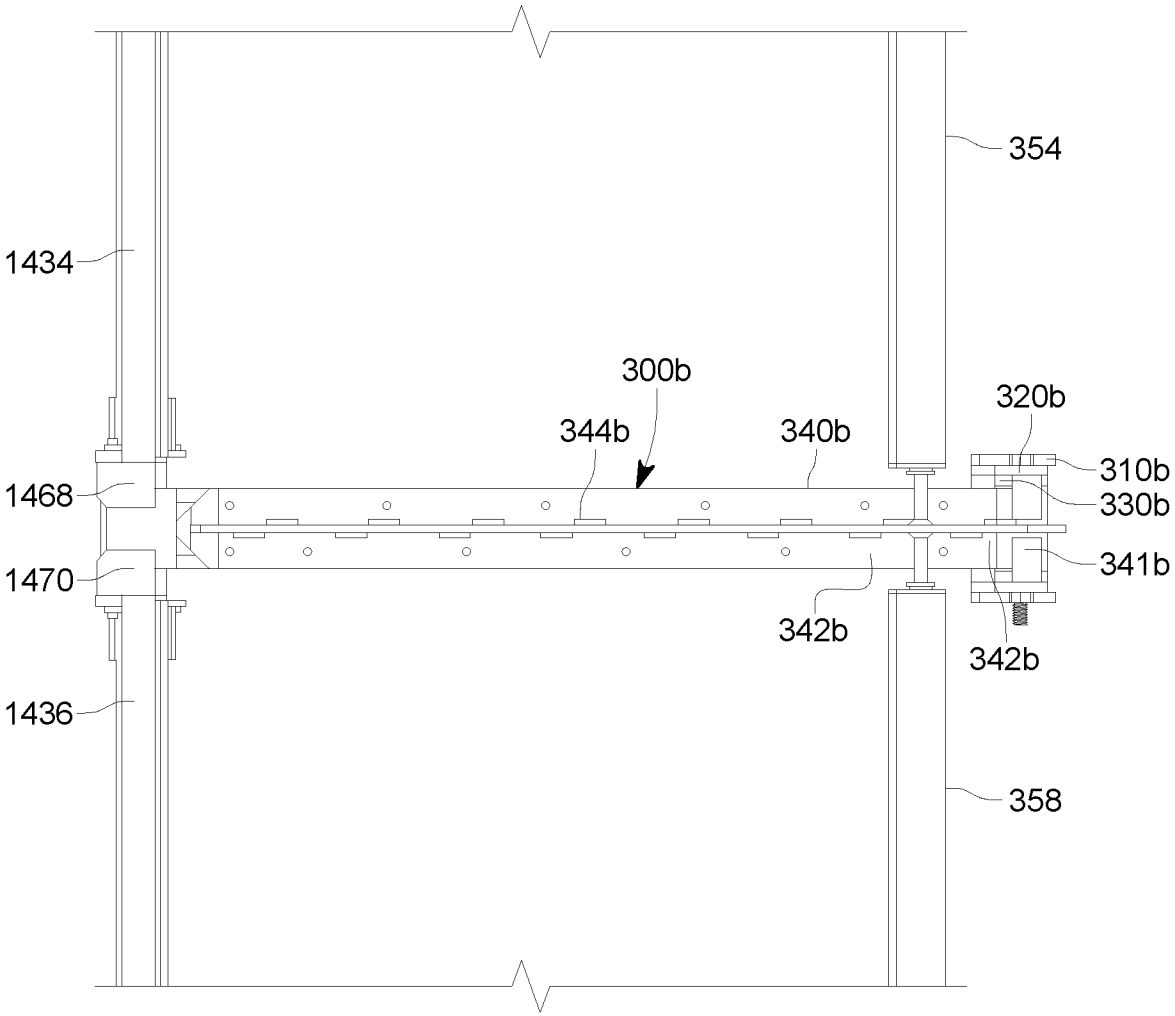

FIG. 18 is an enlarged fragmentary top view of certain parts (including one of the central hinges) of the hatch cover and of certain parts (including one of the hatch cover engagers) of the hatch cover securer of the hatch cover assembly of FIG. 2.

Figure 19:
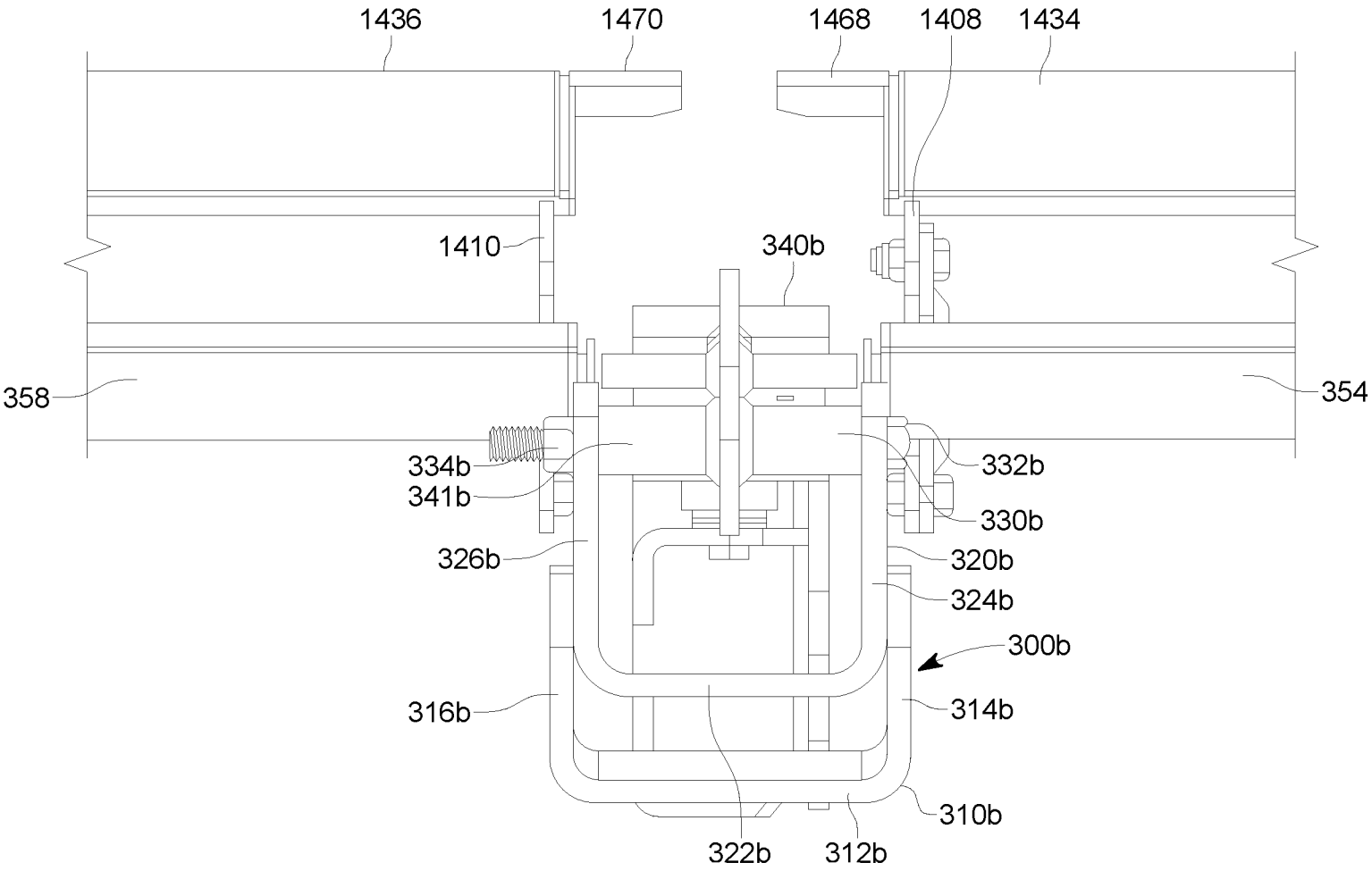

FIG. 19 is an enlarged fragmentary side view of certain parts (including one of the central hinges) of the hatch cover and of certain parts (including one of the hatch cover engagers) of the hatch cover securer of the hatch cover assembly of FIG. 2.

Figure 20:
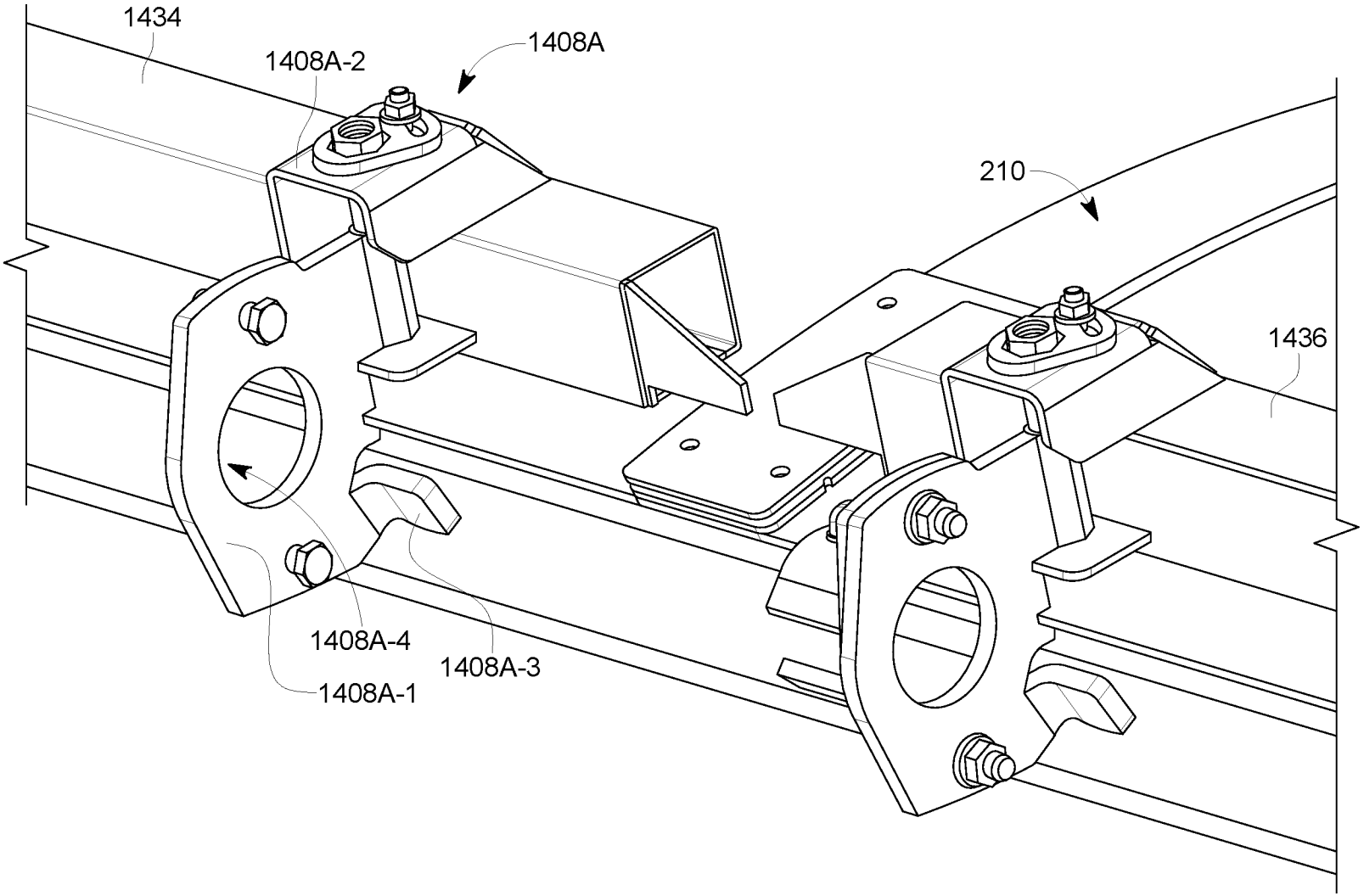

FIG. 20 is an enlarged fragmentary top perspective view of two icebreaker assemblies connected to the hatch cover engagers of FIG. 16 in accordance with another embodiment of the present disclosure.

Figure 21:
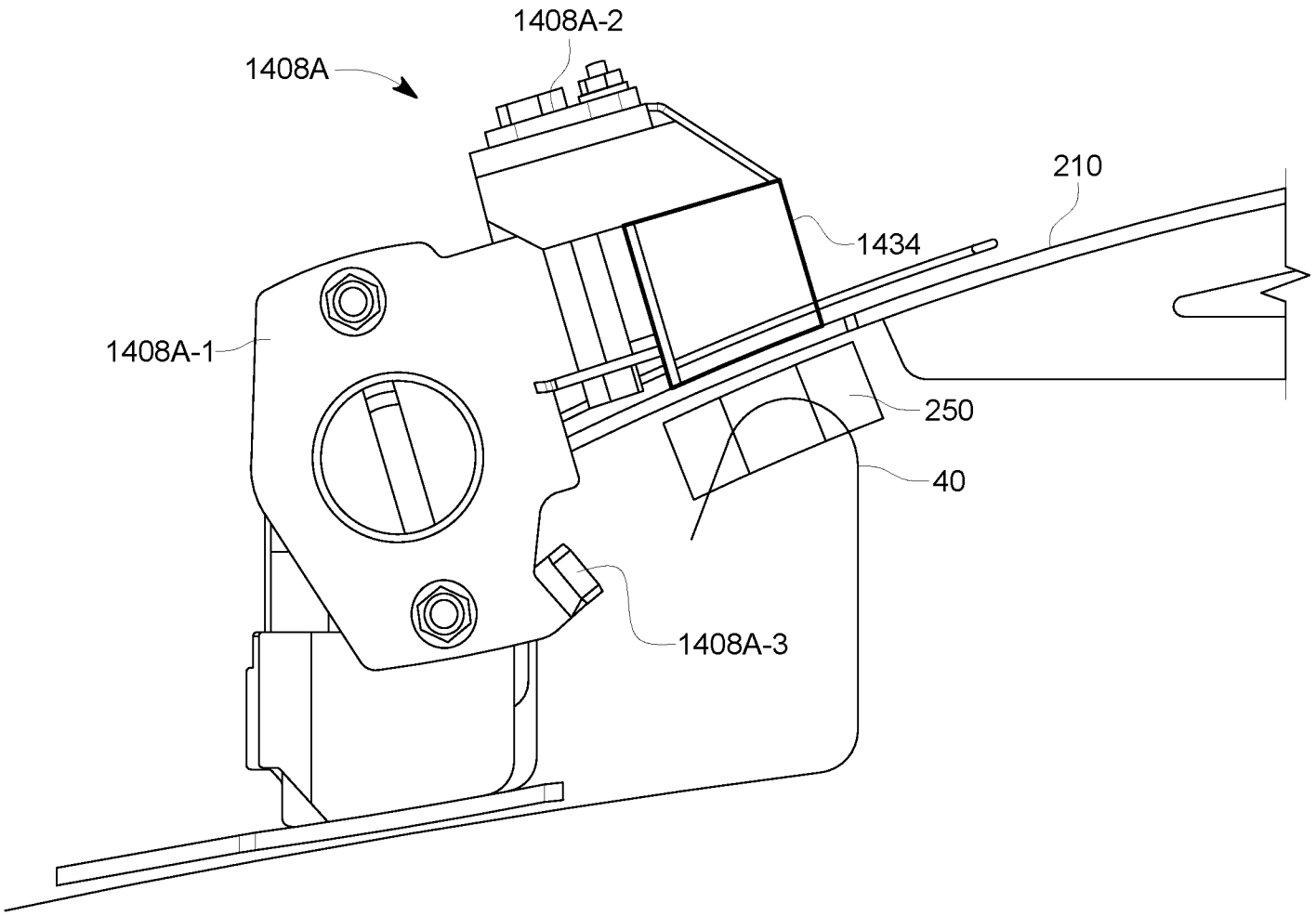

FIG. 21 is an enlarged fragmentary side view of one of the icebreaker assemblies of FIG. 20, shown in a fully locked position.

Figure 22:
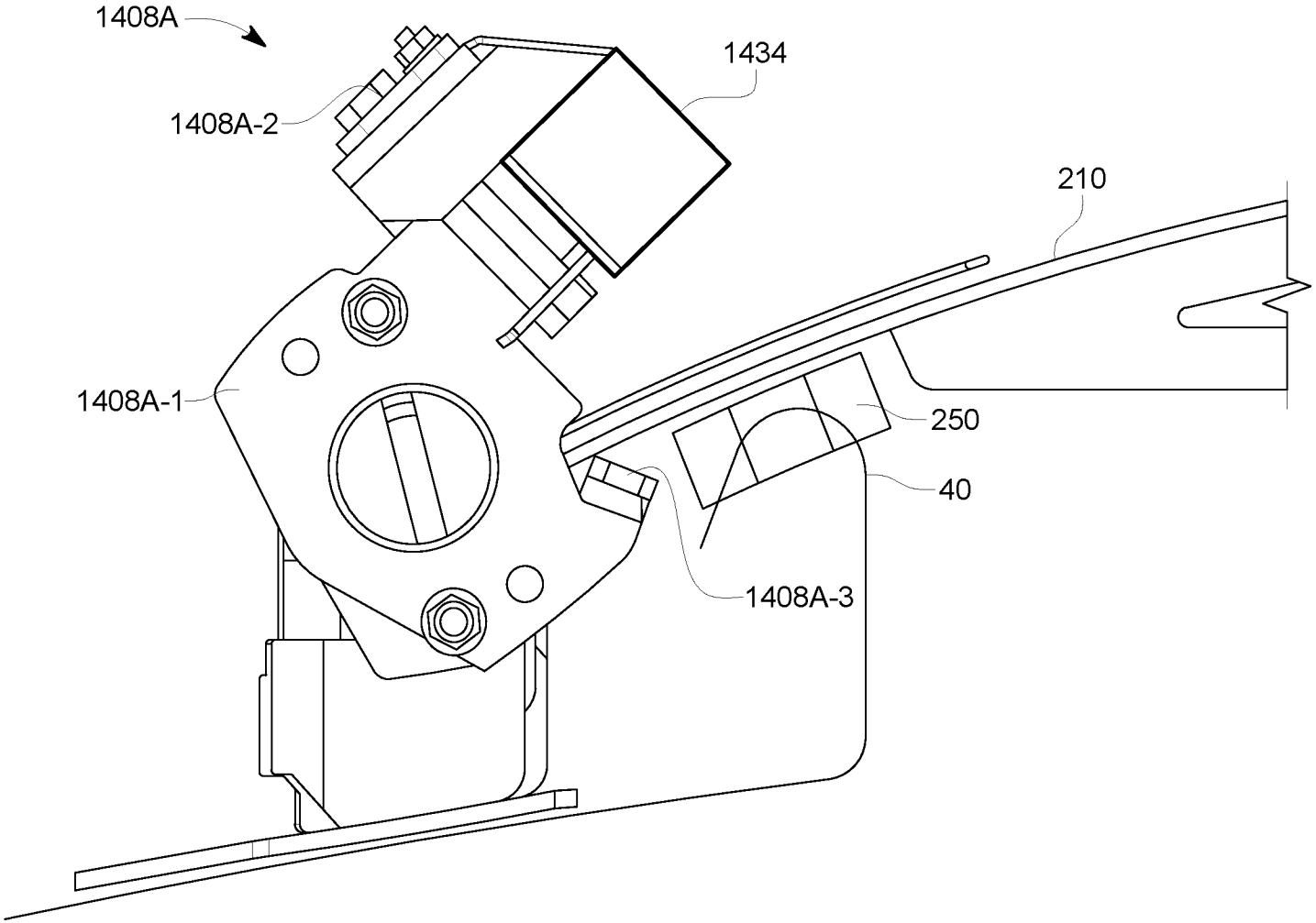

FIG. 22 is an enlarged fragmentary side view of one of the icebreaker assemblies of FIG. 20, shown in an unlocked position.

DETAILED DESCRIPTION

While the features, devices, and apparatus described herein may be embodied in various forms, the drawings show and the specification describe certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as coupled, mounted, connected, and the like, are not intended to be limited to direct mounting methods but should be interpreted broadly to include indirect and operably coupled, mounted, connected and like mounting methods. This specification is intended to be taken as a whole and interpreted in accordance with the principles of the present disclosure and as understood by one of ordinary skill in the art.

Various embodiments of the present disclosure provide a top hatch cover assembly for a railroad hopper railroad car that is partially flexible and that automatically opens and closes. The top hatch cover assembly facilitates automatic opening and closing without requiring additional or external specialized machinery or equipment. The top hatch cover assembly of the present disclosure also eliminates the need for a person to be physically present on roof of the hopper railroad car to open and close the top hatch cover assembly for the loading materials into the hopper railroad car.

In various example embodiments of the present disclosure, the top hatch cover assembly generally includes a hatch cover, a hatch cover securer configured to co-act with and to secure the hatch cover in a closed position, first and second multi-action actuators operably connected to the hatch cover and the hatch cover securer to operate both hatch cover and the hatch cover securer, and a plurality of icebreaker assemblies. The first and second multi-action actuators are configured to unlock and lock the hatch cover securer. The first and second multi-action actuators are also configured to open and close the hatch cover securer. The icebreaker assemblies are configured to co-act with the hatch cover securer to overcome the effects of ice buildup that causes the hatch cover to become stuck in the closed position.

Referring now to the drawings, FIG. 1 partially illustrates an example hopper railroad car 10 having a roof 28 to which the top hatch cover assembly of the present disclosure can be connected. The illustrated example hopper railroad car 10 generally includes: (1) a frame 11; (2) spaced apart trucks 12A and 12B configured to support the frame 11; (3) a plurality of wheels (such as wheel 14) that support the trucks 12A and 12B; (4) a first side wall 20 connected to and supported by the frame 11; (5) a second side wall 22 connected to and supported by the frame 11; (6) a first end wall 24 connected to and supported by the frame 11; (7) a second end wall 26 connected to and supported by the frame 11; and (8) a roof 28 connected to and supported by the side walls 20 and 22, the end walls 24 and 26, and the frame 11. The first and second side walls 20 and 22 are spaced apart. The first and second end walls 24 and 26 are also spaced apart. The hopper railroad car 10 generally includes a first end and a second end. The frame 11, the side walls 20 and 22, the end walls 24 and 26, and the roof 28 define one or more interior compartments (not shown). It should be appreciated that the configuration and size of the hopper railroad car can vary in accordance with the present disclosure. The configuration of the roof 28 of the hopper railroad car can vary, for instance, in the degree of curvature. For example, FIGS. 1 to 15 show one example curved roof. FIG. 1 additionally shows running boards positioned above the curved roof. It should be appreciated that the top hatch cover assembly of the present disclosure can be employed with different hopper railroad cars having differently configured roofs. For brevity, the present disclosure employs only one set of numerals (e.g., 28, 30, 40, and 50) referencing various parts of the example hopper railroad cars shown herein for the different example embodiments of the present disclosure described herein.

As seen in FIGS. 1 to 15, in this illustrated example embodiment, the roof 28 generally includes: (1) a curved panel 30; and (2) a coaming 40 integrally connected to, supported by and upwardly extending from the curved panel 30.

The curved panel 30 is elevated in the middle (from side to side), such that the panel 30 is higher in the middle and is lower at the respective connection points or edges at the respective side walls. This enables the curved panel 30 to deflect rain, snow, and other objects off the roof 28 of the hopper railroad car 10. The curved panel 30 can be made from steel, or any other suitable material. The curved panel 30 is illustrated as having a symmetrical curvature. However, it should be appreciated that the curvature can be asymmetrical in accordance with the present disclosure. It should also be appreciated that the roof 28 can alternatively include a flat (i.e., not curved) panel, a panel including one or more sharp bends rather than a gradual curve, or a panel having a curvature different from that shown in the Figures in accordance with the present disclosure. In addition, the roof 28 can include a single panel or multiple panels connected together in accordance with the present disclosure.

The coaming 40 generally includes an oval upright portion (not labeled) having a top surface (not labeled), an inner surface (not labeled), and an outer surface (not labeled). The coaming 40 extends along a substantial length of the roof 28 and defines an oval or obround opening 50 through which materials can be loaded into the hopper railroad car. In other words, the coaming 40 extends around the opening 50, defining an outer perimeter of the opening 50. The coaming 40 extends above the curved panel 30, and in particular extends from and above the upper surface of the curved panel 30. In the illustrated example, the upright portion of the coaming 40 includes two semicircular end walls (not separately labeled) connected by two parallel spaced apart side walls (not separately labeled). The inner surface of the coaming 40 is adjacent to the opening 50, thereby forming an oblong ring around the opening 50. The outer surface of the coaming 40 is opposite the inner surface of the coaming 40. The top surface of the coaming 40 is opposite the top surface of the curved panel 30 and extends from the inner surface to the outer surface. The top surface is curved from the inner surface to the outer surface. In other embodiments, the coaming includes an upper curved flange that defines the top surface of the coaming. It should be appreciated that the present disclosure can be employed with other suitably shaped coamings, or with other alternative roof structures.

Referring now more specifically to FIGS. 2 to 19, one example top hatch cover assembly 100 of the present disclosure is generally shown. This example illustrated top hatch cover assembly 100 generally includes: (1) a hatch cover 150 suitably connected on one side of the coaming 40 to the cover panel 30 of the roof 28 and including an elongated movable hatch 200 pivotally movable from a closed position engaging the coaming 40 to a fully open position away from the coaming 40; (2) a hatch cover securer 1000 suitably connected on the other side of the coaming 40 to the cover panel 30 of the roof 28 and including a hatch cover engager 1400 pivotally or rotatably movable from a hatch cover engagement position in which the hatch cover engager 1400 secures the hatch cover 150 in the closed position engaging the coaming 40 to a hatch cover non-engagement position in which the hatch cover engager 1400 allows the hatch 200 of the hatch cover 150 to move to the fully open position, as further explained herein; (3) first and second multi-action actuators 600 and 700 operably connected to the hatch cover 150 and the hatch cover securer 1000 to operate both the hatch cover 150 and the hatch cover securer 1000; and (4) a plurality of icebreaker assemblies 800 operably connected to the hatch cover engager 1400 to overcome the effects of ice buildup that causes the hatch cover 150 to become stuck in the closed position.

More specifically, the hatch cover 150 includes: (1) a flexible elongated movable hatch 200; (2) a plurality of spaced apart central hinges 300*a*, 300*b*, 300*c*, 300*d*, 300*e*, and 300*f* suitably connected to the hatch 200 and the curved panel 30 of the roof 28; (3) a first end hinge 400 suitably connected to a first end 202 of the hatch 200 and the curved panel 30 of the roof 28; and (4) a second end hinge 500 suitably connected to an opposite second end 252 of the hatch 200 and the curved panel 30 of the roof 28.

The hatch cover 150 is suitably connected to the roof 28, and more particularly to the curved panel 30 by the hinges 300*a*, 300*b*, 300*c*, 300*d*, 300*e*, 300*f*, 400, and 500. The hatch 200 of the hatch cover 150 is configured to securely engage and provide a seal with the coaming 40 when in a closed position (such as shown in FIGS. 2, 3, 6, 7, 8, 11, 12, and 13). The hatch 200 of the hatch cover 150 is configured to disengage from the coaming 40 and move to various open positions (such as shown in FIGS. 4, 5, 9, 10, 14, and 15). The hatch 200 of the hatch cover 150 is configured to move and particularly rotate between the fully open position (shown in FIGS. 4, 5, 10, and 15) and the closed position. Thus, the hatch 200 of the hatch cover 150 is configured to unseal and seal the hopper railroad car 10 by moving from the fully open position to the closed position, and vice versa. The hatch 200 and certain other parts of the hatch cover 150 are configured to be secured in the fully closed position by the hatch cover securer 1000, as further described herein.

The elongated movable hatch 200 of the hatch cover 150 generally includes a first end 202 and an opposite second end 252. The elongated movable hatch 200 includes: (1) a flexible elongated panel 210; and (2) an elongated oblong coaming sealer 250 suitably connected to the bottom of the flexible elongated panel 210.

The flexible elongated panel 210 is generally rectangular, is larger than the coaming 40, and is larger than the opening 50. The panel 210 has a top surface (not labeled), a bottom surface (not labeled), a first side edge (not labeled), a second side edge (not labeled), a first end edge (not labeled), and a second end edge (not labeled). It should also be appreciated that the panel 210 is large enough relative to the coaming 40 such that when the elongated movable hatch 200 of the hatch cover 150 is in the closed position engaging the coaming 40, that the first side edge, the second side edge, the first end edge, and the second end edge each extend outwardly of the coaming 40. The panel 210 is made from a relatively light weight flexible material that is also semi-rigid in certain embodiments. In this example, the material of the panel 210 is made from a conveyor belt type material such as reinforced tarpaulin, reinforced plastic, reinforced rubber, or a suitable lamination using one or more of such materials and/or other suitable materials. However, it should be appreciated that the material can be any other suitable material in accordance with the present disclosure. It should also be appreciated that the elongated panel can include one or more internal and/or external supporting members that provide a desired amount of support and rigidity to the material of the elongated panel in accordance with the present disclosure. It should also be appreciated that while this example panel 210 is made from one continuous section of material, the present disclosure contemplates that the panel 210 can be made from two or more sections that are suitably connected, and in certain such embodiments overlapping. It should also be appreciated that while this example panel 210 is made from one continuous layer of material, the present disclosure contemplates that the panel 210 can be made from two or more layers of material. It should also be appreciated that while this example panel 210 is rectangular, the present disclosure contemplates that the panel 210 can be made in other suitable shapes and sizes. It should be appreciated that the structure of the panel 210 is such that the panel 210 can be lifted from either end (or both ends) and that the flexible material will enable part of the elongated panel to be lifted without lifting the entire panel 210, and such that adjacent central sections of the panel 210 will be sequentially lifted.

The elongated coaming sealer 250 that functions in part as a gasket includes a generally oval ring that is slightly wider than the top surface of the coaming 40, and is larger than the opening 50. The coaming sealer 250 has a top surface (not labeled), a bottom surface (not labeled), an outer surface (not labeled), and an inner surface (not labeled). The coaming sealer 250 is suitably connected to the bottom of the elongated panel 210. In this example embodiment, the top surface of the sealer 250 is suitably connected to the bottom surface of the panel 210 (such as by using a suitable adhesive). The coaming sealer 250 includes two spaced apart-straight sections, and two spaced apart curved sections that respectively correspond to the two straight sections and two curved walls of the coaming 40. It should also be appreciated that the coaming sealer 250 is large enough relative to the coaming 40 such that when the elongated movable hatch 200 of the hatch cover 150 is in the closed position engaging the coaming 40, the bottom surface of the elongated coaming sealer 250 engages and seals the entire top surface of the coaming 40. The coaming sealer 250 is made from a relatively light weight flexible rubber material; however, it should be appreciated that the material of the coaming sealer 250 can be any other suitable material in accordance with the present disclosure. It should also be appreciated that while this example coaming sealer 250 is made from one continuous section of material, the present disclosure contemplates that the coaming sealer 250 can be made from two or more sections that are suitably connected, and in certain such embodiments overlapping. It should also be appreciated that while this example coaming sealer 250 is made from one continuous layer of material, the present disclosure contemplates that the coaming sealer can be made from two or more layers of material. It should be appreciated that the coaming sealer 250 is compressible such that when it engages the top surface 44 of the coaming 40, it compresses to form a seal with the coaming 40. It should also be appreciated that while this example sealer 250 is oval (to align with, correspond to, and seal the oval coaming), the present disclosure contemplates that the sealer 250 can be made in other suitable shapes and sizes. It should be appreciated that the structure of the sealer 250 is such that the coaming sealer 250 can be lifted with the lifting of the panel 210 from either end and that the sealer 250 will enable part of the panel 210 to be lifted without lifting the entire panel 210 and such that adjacent sections of the panel 210 can be sequentially lifted. It should also be appreciated that the sealer 250 could alternatively or additionally include one or more sections that are configured to engage: (a) the inner and/or outer surfaces of the coaming 40, or (b) only the inner and/or outer surfaces of the coaming 40, in accordance with the present disclosure. In other words, the sealer 250 can be suitably configured to create a seal on one or more selected surfaces of the coaming. Additionally, it should be appreciated as further explained herein that the hatch cover 150 and the hatch cover securer 1000 are configured to co-act to create an even or substantially even seal along the entire lengths and along the curvatures of the seal 250, and are further configured to provide more than 5 pounds of pressure along every three inches of the sealer 250.

As mentioned above, the hatch cover 150 includes spaced apart central hinges 300*a*, 300*b*, 300*c*, 300*d*, 300*e*, and 300*f* suitably connected to the hatch 200. More specially, each of these central hinges 300*a*, 300*b*, 300*c*, 300*d*, 300*e*, and 300*f* is suitably connected to the elongated panel 210 by a plurality of fasteners (not shown or labeled). It should also be appreciated that the elongated panel 210 can be otherwise suitably attached to the central hinges such as using an adhesive or other suitable attachment mechanism. In this illustrated example embodiment, each of the central hinges 300*a*, 300*b*, 300*c*, 300*d*, 300*e*, and 300*f* is identical, and thus only central hinge 300*b* (best shown in FIGS. 16, 17, 18, and 19) is discussed in detail for brevity. It should be appreciated that the central hinges 300*a*, 300*b*, 300*c*, 300*d*, 300*e*, and 300*f* do not need be identical in accordance with the present disclosure. It should also be appreciated that the quantity and spacing of the central hinges can vary in accordance with the present disclosure.

More specifically, as shown in FIGS. 16, 17, 18, and 19, the central hinge 300*b* generally includes: (1) a mounting bracket 310*b* suitably connected to the curved panel 30 of the roof 28; (2) a pivot pin bracket 320*b* suitably connected to the mounting bracket 310*b*; (3) a pivot pin assembly 330*b* suitably connected to the pivot pin bracket 320*b*; and (4) a pivot arm 340*b* suitably pivotally connected to the pivot pin bracket 320*b* by the pivot pin assembly 330*b* and suitably connected to the elongated panel 210.

The mounting bracket 310*b* includes: (1) a mounting base 312*b*; (2) a first mounting leg 314*b* integrally connected to and extending upwardly from the mounting base 312*b*; and (3) a second mounting leg 316*b* integrally connected to and extending upwardly from the mounting base 312*b*. The second mounting leg 316*b* is aligned with and spaced apart from the first mounting leg 314*b*. The mounting base 312*b* is suitably connected to the roof 28 and specifically to curved panel 30 of the roof 28 adjacent to the coaming 40, as best shown in FIG. 16. The mounting bracket 310*b* is made of steel in this example embodiment. It should be appreciated that the mounting bracket 310*b* can be alternatively sized, configured, and made of different materials in accordance with the present disclosure.

The pivot pin bracket 320*b* includes: (1) a base 322*b*; (2) a first mounting arm 324*b* integrally connected to and extending upwardly from the base 322*b*; and (3) a second mounting arm 326*b* integrally connected to and extending upwardly from the base 322*b*. The second mounting arm 326*b* is aligned with and spaced apart from the first mounting arm 324*b*. The first mounting arm 324*b* is integrally connected to the first mounting arm 314*b* of the mounting bracket 310*b*. The second mounting arm 326*b* is integrally connected to the second mounting arm 316*b* of the mounting bracket 310*b*. The first mounting arm 324*b* defines an opening (not shown or labeled) for receiving part of the pivot pin assembly 330*b*. The second mounting arm 324*b* also defines an opening (not shown or labeled) for receiving part of the pivot pin assembly 330*b*. The openings of the first mounting arm 324*b* and the second mounting arm 324*b* are aligned. The pivot pin bracket 320*b* is mounted relative to the mounting bracket 310*b* to facilitate a suitable amount of clearance for pivoting and rotation of the pivot arm 340*b* relative to the roof 28 and specifically to the curved panel 30 of the roof 28 as well as the coaming 40 of the roof 28. The pivot pin bracket 320*b* is made of steel in this example embodiment. It should be appreciated that the pivot pin bracket 320*b* can be alternatively sized, configured, and made of different materials in accordance with the present disclosure.

The pivot pin assembly 330*b* includes: (1) a bolt 332*b* that extends through the openings in first mounting arm 324*b* and the second mounting arm 326*b*; (2) a nut 334*b* suitably connected to the bolt 332*b*; and (3) a collar 341*b* freely rotatably journaled about the bolt 332*b* between the first mounting arm 324*b* and the second mounting arm 326*b*.

Although not shown, the pivot pin assembly 330*b* can include one or more suitable washers. The pivot pin assembly 330*b* is made of steel in this example embodiment. It should be appreciated that the pivot pin assembly 330*b* can be alternatively sized, configured, and made of different materials in accordance with the present disclosure.

The pivot arm 340*b* includes: (1) an elongated hatch connector base 342*b*; and (2) an elongated support wall 344*b* integrally centrally connected to and upwardly extending from the elongated hatch connector base 342*b*. The hatch connector base 342*b* includes a bottom surface 343*b* that is positioned on the top surface of the elongated panel 210 of the hatch 200. The hatch connector base 342*b* includes a plurality of openings (not labeled) for suitable fasteners (not labeled) that connect the hatch connector base 342*b* (and thus the pivot arm 340*b*) to the panel 210. The support wall 344*b* adds structural support to the hatch connector base 342*b* and facilitates the rotation of the hatch 200. The elongated support wall 344*b* is integrally connected to the collar 341*b* of the pivot pin assembly 330*b*. This configuration enables the pivot arm 340*b* and the section of the panel 210 of the hatch 200 to pivot about the pivot pin assembly 330*b* and relative to the pivot pin bracket 320*b*, the coaming 40, and the roof 28. The pivot arm 340*b* is made of steel in this example embodiment. It should be appreciated that the pivot arm 340*b* can be alternatively sized, configured, and made of different materials in accordance with the present disclosure.

In this illustrated example embodiment, the hatch cover 150 additionally includes a plurality of additional hatch engagement members 350, 354, 358, 362, 366, 370, and 374 extending between and suitably rotatably and pivotally connected to and between pairs of respective pivot arms of the hinges including spaced apart hinges 400, 300*a*, 300*b*, 300*c*, 300*d*, 300*e*, 300*f*, and 500. It should be appreciated that for the pivot arms to lift sequentially, the connections between the engagement members and the pivot arms allow for more motion than just rotation. The engagement member is free to pivot vertically relative to each respective pivot arm, such that one end of the engagement member can be lifted before the other. More specifically, (1) additional hatch engagement member 350 extends between and is suitably connected to and between the pivot arm (not labeled) of hinge 400 and the pivot arm of 300*a* by respective bosses (not labeled) that are each rotatably and pivotally connected to the respective pivot arms; (2) additional hatch engagement member 354 extends between and is suitably connected to and between the pivot arm of hinge 300*a* and the pivot arm of 300*b* by respective bosses (not labeled) that are each rotatably and pivotally connected to the respective pivot arms; (3) additional hatch engagement member 358 extends between and is suitably connected to and between the pivot arm of hinge 300*b* and the pivot arm of 300*c* by respective bosses (not labeled) that are each rotatably and pivotally connected to the respective pivot arms; (4) additional hatch engagement member 362 extends between and is suitably connected to and between the pivot arm of hinge 300*c* and the pivot arm of 300*d* by respective bosses (not labeled) that are each rotatably and pivotally connected to the respective pivot arms; (5) additional hatch engagement member 366 extends between and is suitably connected to and between the pivot arm of hinge 300*d* and the pivot arm of 300*e* by respective bosses (not labeled) that are each rotatably and pivotally connected to the respective pivot arms; (6) additional hatch engagement member 370 extends between and is suitably connected to and between the pivot arm of hinge 300*e* and the pivot arm of 300*f* by respective bosses (not labeled) that are each rotatably and pivotally connected to the respective pivot arms; and (7) additional hatch engagement member 374 extends between and is suitably connected to and between the pivot arm of hinge 300*f* and the pivot arm 560 (described below) of hinge 500 by respective bosses (not labeled) that are each rotatably and pivotally connected to the respective pivot arms. Each of the additional hatch engagement members 350, 354, 358, 362, 366, 370, and 374 has a square cross-section and four flat surfaces. Each of the additional hatch engagement members 350, 354, 358, 362, 366, 370, and 374 is configured to freely rotate and pivot relative to the spaced apart pivot arms to which it is attached. This free rotation and pivotal movement enables the opening of the hatch cover 150 and particularly the hatch 200 from either or both ends. For instance, as the hatch 200 is opened from the first end 202, the first additional hatch engagement member 350 can rotate and pivot as the flexible hatch 200 moves upwardly. This allowed rotation and pivotal movement prevents the bending of the additional hatch engagement member 350. This free rotation also enables the closing of the hatch cover 150 and particularly the hatch 200 from either or both ends in the same manner. It should also be appreciated that these rotational and pivotal connections enable each pivot arm to move independently and each section of the panel 210 to be lifted (or lowered) sequentially. Each additional hatch engagement member is configured to engage a portion of the top surface of the hatch 200 over a section of the hatch 200 that includes the seal 250 to thus apply an even amount of pressure to that portion of the hatch 200 and that portion of the seal 250. Each additional hatch engagement member is made of steel in this example embodiment. It should be appreciated that the additional hatch engagement members can be alternatively sized, configured, and made of different materials in accordance with the present disclosure.

As mentioned above, the hatch cover 150 includes the first end hinge 400 suitably connected to a first end 202 of the hatch 200 and the second end hinge 500 suitably connected to a second end 252 of the hatch 200. More specially, each of these hinges 400 and 500 is suitably connected to opposite ends of the elongated panel 210. In this illustrated example embodiment, each of the hinges 400 and 500 are mirror images of each other, and thus end hinge 500 is primarily discussed in detail for brevity. It should be appreciated that the first and second end hinges 400 and 500 do not need be exact mirror images in accordance with the present disclosure.

Figure 6:
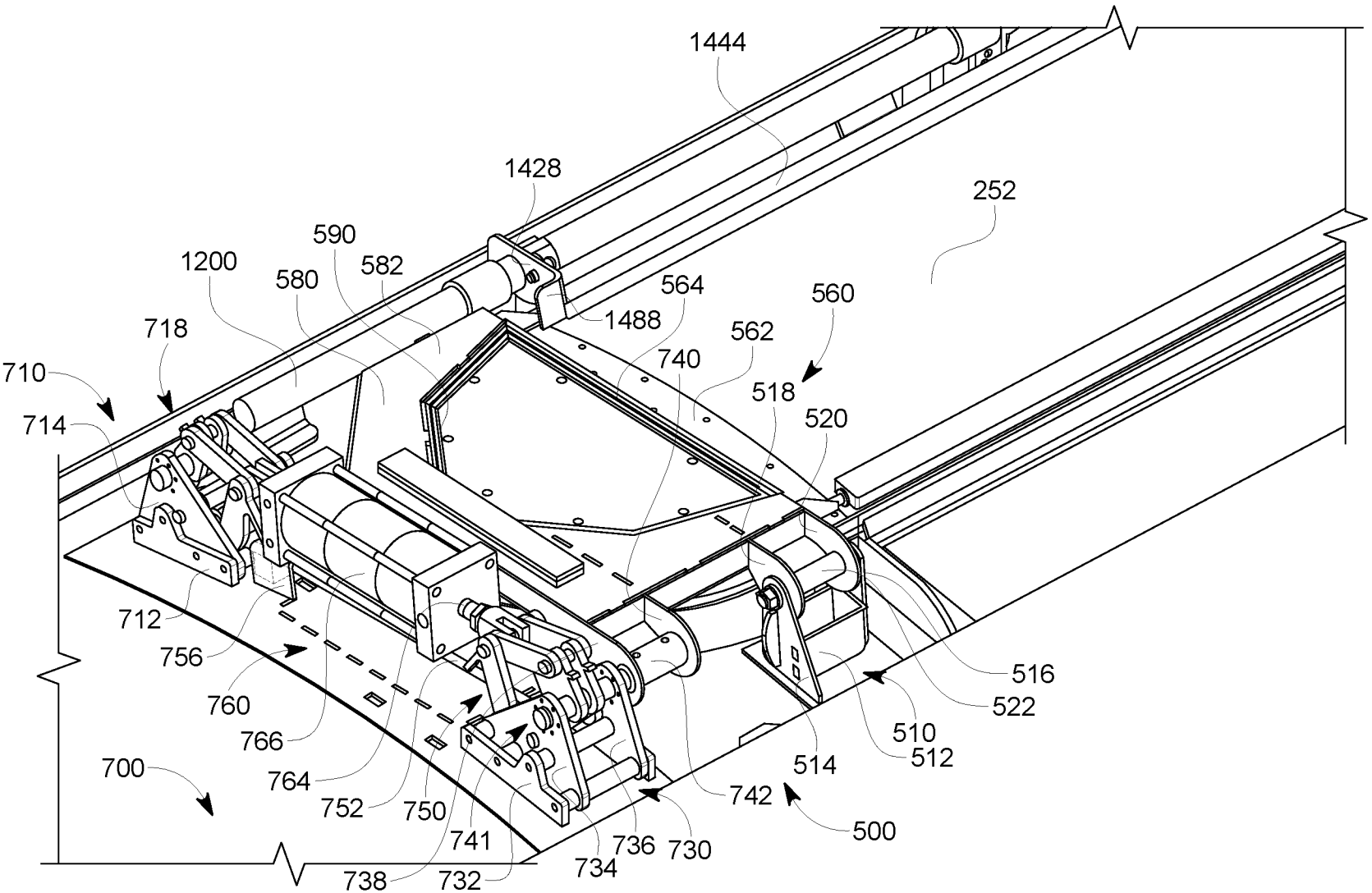
FIG. 6 is a further enlarged fragmentary top perspective view of a second end of the roof of the example hopper railroad car of FIG. 1, and a second end of the top hatch cover assembly of FIG. 2 shown connected to the second end of the roof of the hopper railroad car of FIG. 1 and shown in the closed position.
Figure 7:
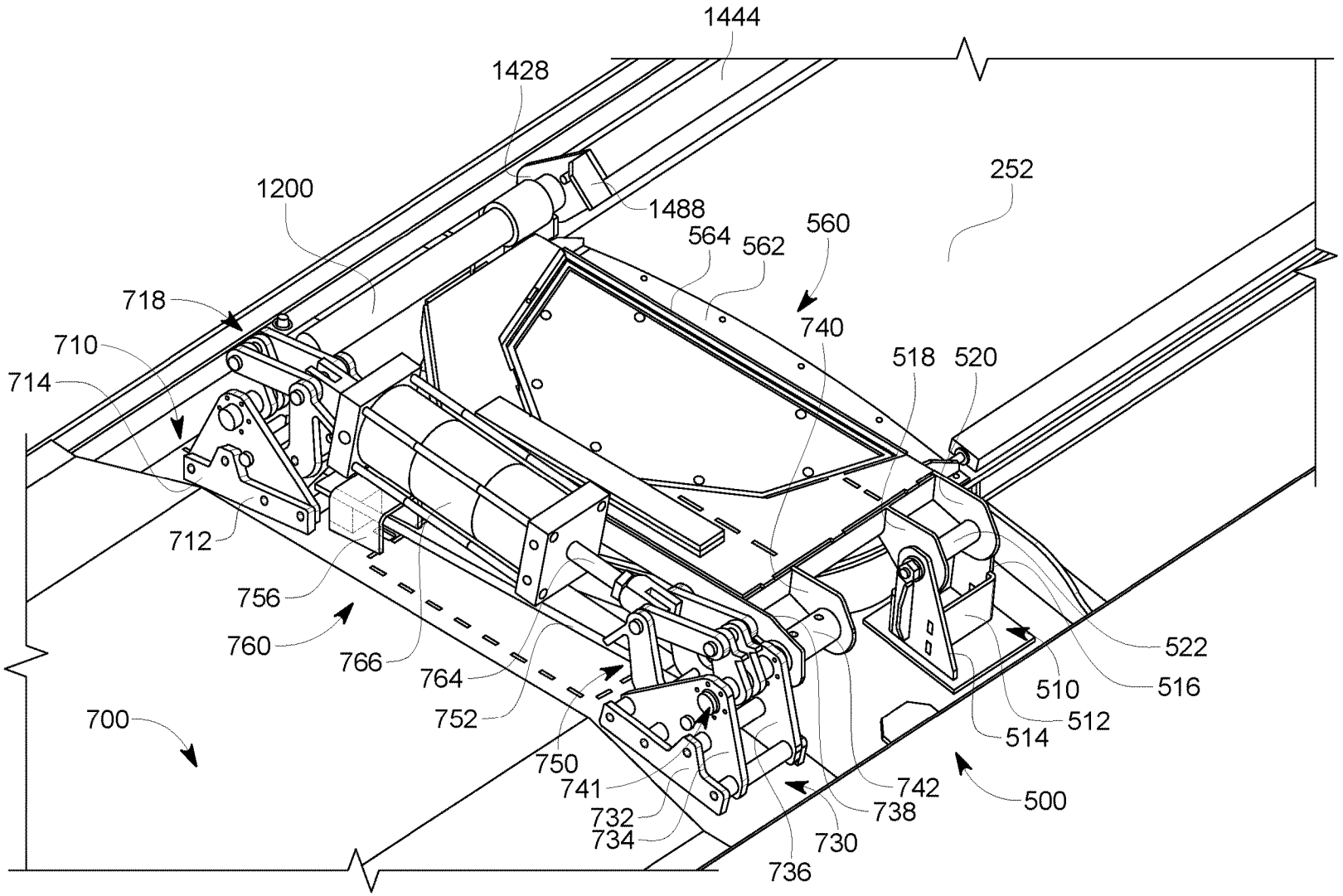
FIG. 7 is a further enlarged fragmentary top perspective view of the second end of the roof of the example hopper railroad car of FIG. 1, and the second end of the top hatch cover assembly of FIG. 2 shown connected to the second end of the roof of the hopper railroad car of FIG. 1 and shown in a partially unlocked and fully closed position.
Figure 8:
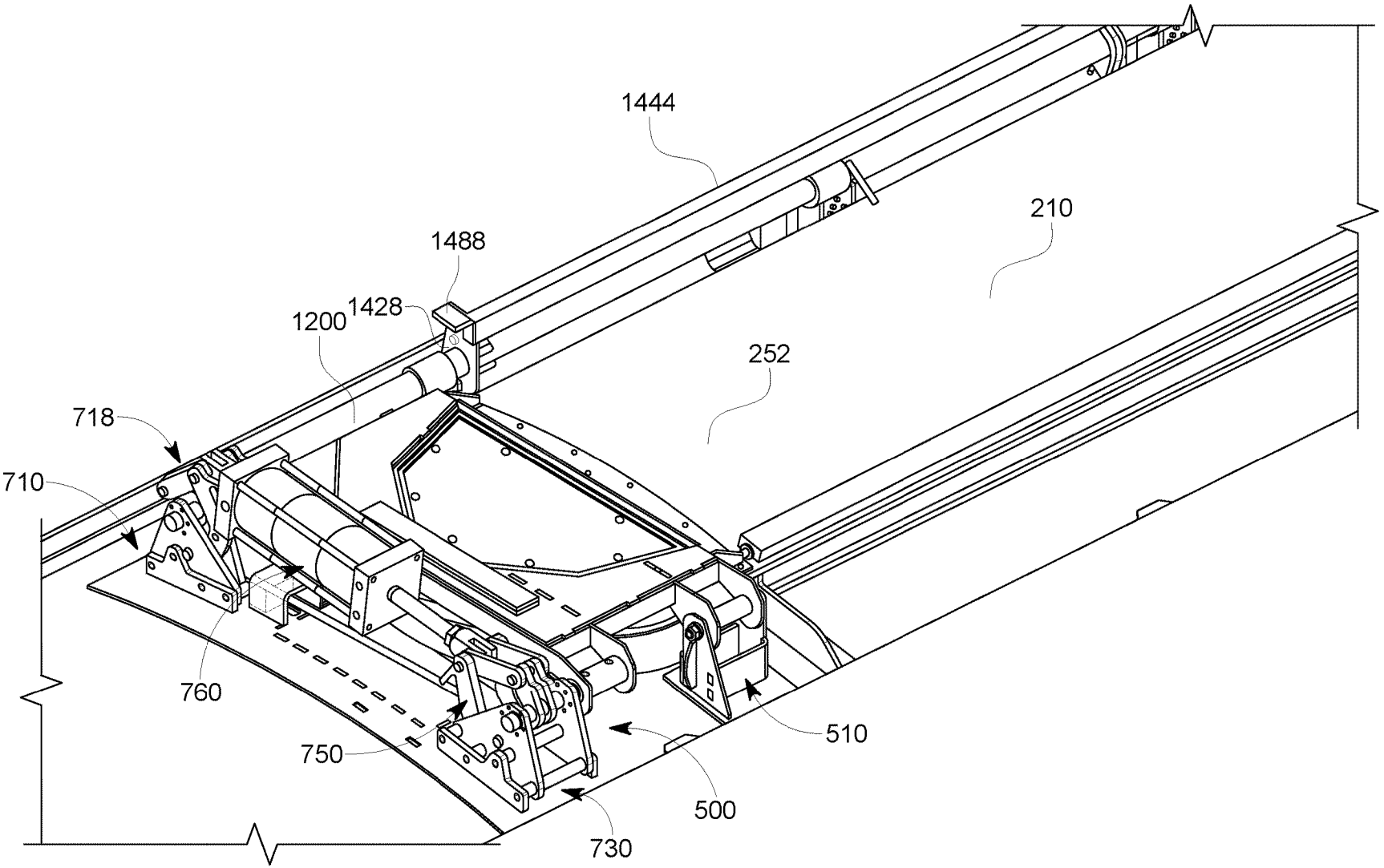
FIG. 8 is a further enlarged fragmentary top perspective view of the second end of the roof of the example hopper railroad car of FIG. 1, and the second end of the top hatch cover assembly of FIG. 2 shown connected to the second end of the roof of the hopper railroad car of FIG. 1 and shown in a fully unlocked and fully closed position.
Figure 9:
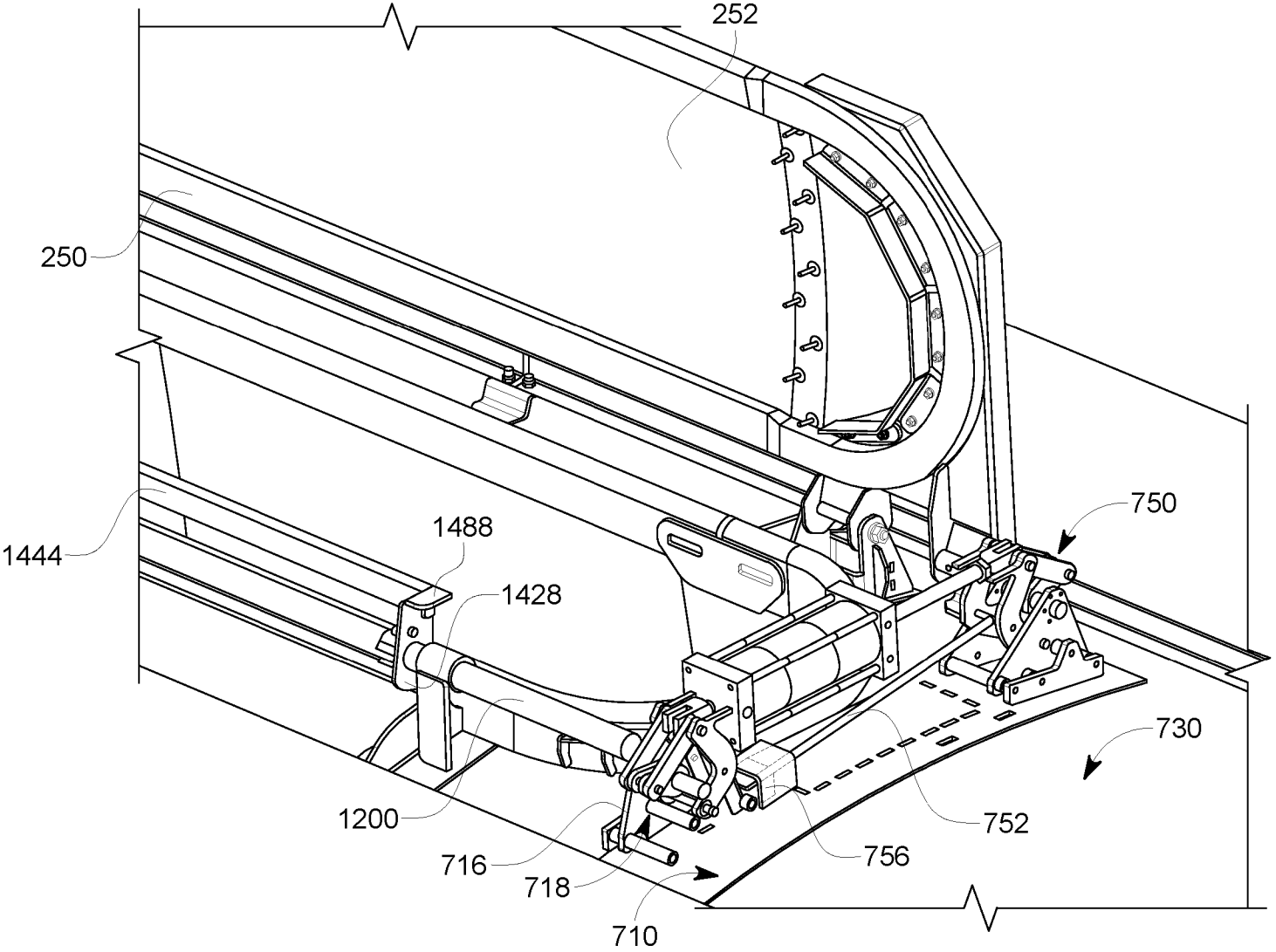
FIG. 9 is a further enlarged fragmentary top perspective view of the second end of the roof of the example hopper railroad car of FIG. 1, and the second end of the top hatch cover assembly of FIG. 2 shown connected to the second end of the roof of the hopper railroad car of FIG. 1 and shown in a partially open position.

As best shown in FIGS. 6, 7, and 8, the hinge 500 generally includes: (1) a mounting bracket assembly 510; (2) a pivot arm 560 suitably pivotally connected to the mounting bracket assembly 510; and (3) a hinge plate 580 suitably pivotally connected to the mounting bracket assembly 510.

More specifically, the mounting bracket assembly 510 includes: (1) a mounting base 512; (2) a first mounting leg 514 integrally connected to the mounting base 512; and (3) a second mounting leg 516 integrally connected to the mounting base 512. The second mounting leg 516 is aligned with and spaced apart from the first mounting leg 514. The mounting base 512, the first mounting leg 514, and the second mounting leg 516 are suitably connected to the roof 28 and specifically to the curved panel 30 of the roof 28 adjacent to the coaming 40 as best shown in FIGS. 6, 7, and 8. The mounting bracket assembly 510 further includes: (4) a first mounting arm 518 integrally connected to and extending from the hinge plate 580; and (5) a second mounting arm 520 integrally connected to and extending from the hinge plate 580. The second mounting arm 520 is aligned with and spaced apart from the first mounting arm 518. The first mounting arm 518 defines an opening (not shown or labeled) for receiving part of a pivot pin assembly 522. The second mounting arm 520 also defines an opening (not shown or labeled) for receiving part of the pivot pin assembly 522. The openings of the first mounting arm 518 and the second mounting arm 520 are aligned. The first mounting arm 518 and the second mounting arm 520 are pivotally mounted to the first mounting leg 514 and the second mounting leg 516 by the pivot pin assembly to facilitate a suitable amount of clearance for pivoting and rotation of the first mounting arm 518 and the second mounting arm 520 relative to the roof 28 and specifically the curved panel 30 of the roof 28 and the coaming 40 of the roof 28. The pivot pin assembly 522 includes: (1) a bolt (not labeled) that extends through the openings in first mounting arm 518 and the second mounting arm 520; (2) a nut (not labeled) connected to the bolt; and (3) a collar (not labeled) freely rotatably journaled about the bolt between the first mounting arm 518 and the second mounting arm 520. Although not shown, the pivot pin assembly 522 can include one or more suitable washers. The mounting bracket assembly 510 is made of steel in this example embodiment. It should be appreciated that the mounting bracket assembly 510 can be alternatively sized, configured, and made of different materials in accordance with the present disclosure.

The pivot arm 560 includes: (1) an elongated hatch connector base 562; and (2) an elongated support wall 564 integrally centrally connected to and upwardly extending from the elongated hatch connector base 562. The hatch connector base 562 includes a bottom surface (not labeled) that is positioned on the top surface of the elongated panel 210 of the hatch 200. The hatch connector base 562 includes a plurality of openings (not labeled) for suitable fasteners (not labeled) that connect the hatch connector base 562 (and thus the pivot arm 560) to the panel 210. The support wall 564 adds structural support to the hatch connector base 562 and facilitates the rotation of the hatch 200. The elongated hatch connector base 562 and the elongated support wall 564 are integrally connected to the second mounting arm 520, the collar of the pivot pin assembly 522, and the hinge plate 580. This configuration enables the pivot arm 560 and the section of the panel 210 of the hatch 200 to pivot relative to the mounting bracket assembly 510, the coaming 40, and the roof 28. The pivot arm 560 is made of steel in this example embodiment. It should be appreciated that the pivot arm 560 can be alternatively sized, configured, and made of different materials in accordance with the present disclosure.

The hinge plate 580 includes a top portion 582 and a bottom portion 590 suitably connected by a plurality of fasteners (not labeled) to the hatch as best shown in FIG. 6. The hinge plate 580 is made of steel in this example embodiment. It should be appreciated that the hinge plate 580 can be alternatively sized, configured, and made of different materials in accordance with the present disclosure.

This configuration enables the hinge plate 580 and the second end of the hatch 200 of the hatch cover 150 to pivot via the mounting bracket assembly 510 relative to the coaming 40, the cover panel 30, and the roof 28.

Turning now to the illustrated example hatch cover securer 1000, the hatch cover securer 1000 generally includes: (1) a mounting assembly 1110; (2) a hatch cover engager rotator 1200 supported by the mounting assembly 1110; (3) a biasing assembly 1300 suitably connected to the hatch cover engager rotator 1200; and (4) a hatch cover engager 1400 suitably connected to the hatch cover engager rotator 1200.

Figure 4:
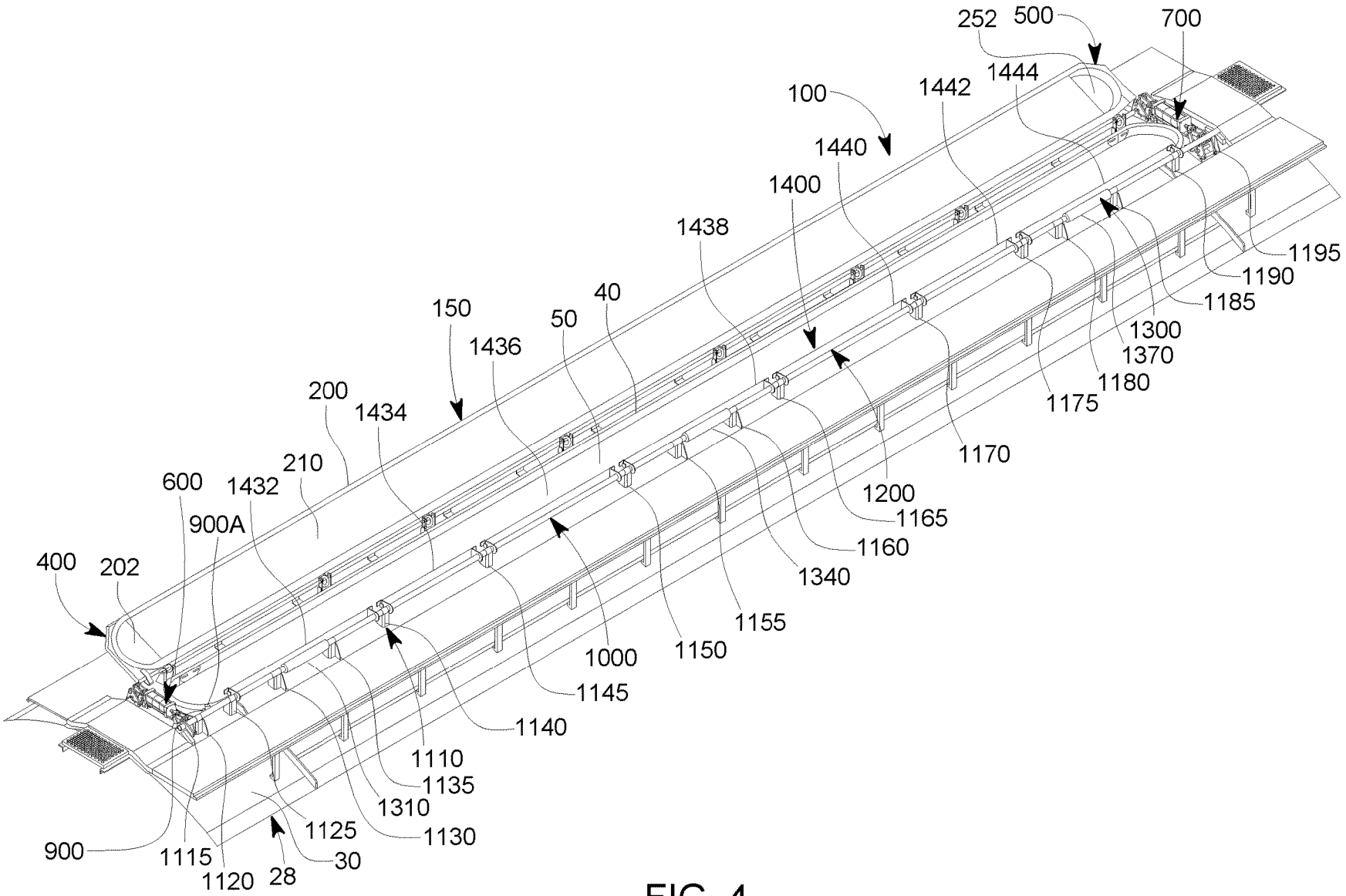
FIG. 4 is a top perspective view of the roof of the hopper railroad car of FIG. 2, and the top hatch cover assembly of FIG. 2 shown connected to the roof of the hopper railroad car of FIG. 1 and shown in an open position.
Figure 5:
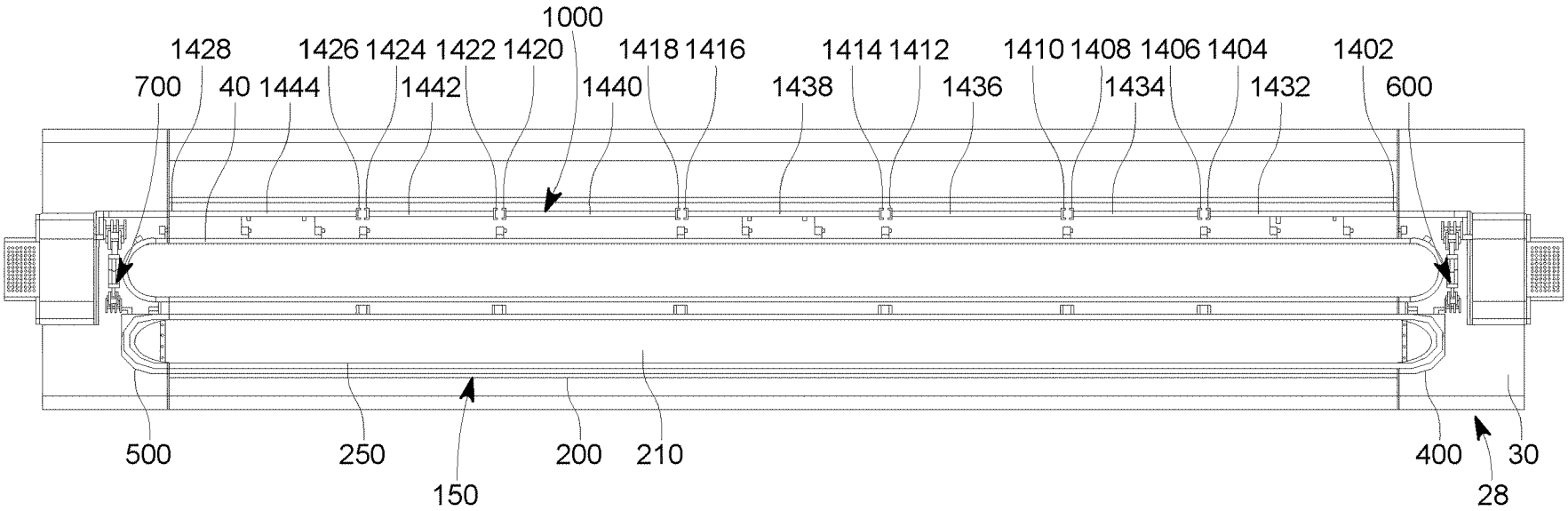
FIG. 5 is a top view of the roof of the example hopper railroad car of FIG. 2, and the top hatch cover assembly of FIG. 2 shown connected to the roof of the hopper railroad car of FIG. 1 and shown in an open position.

The mounting assembly 1110 includes a plurality of spaced apart mounting brackets such as mounting brackets 1115, 1120, 1125, 1130, 1135, 1140, 1145, 1150, 1155, 1160, 1165, 1170, 1175, 1180, 1185, 1190, and 1195, as generally shown in FIGS. 2 and 4. These mounting brackets 1115, 1120, 1125, 1130, 1135, 1140, 1145, 1150, 1155, 1160, 1165, 1170, 1175, 1180, 1185, 1190, and 1195 are configured to support the hatch cover engager rotator 1300 such that the hatch cover engager rotator 1300 can rotate: (1) from a first position shown in FIGS. 2, 3, 6, and 11; (2) to a second position shown in FIGS. 4, 5, 10, and 15; and (3) back to the first position. These mounting brackets 1115, 1120, 1125, 1130, 1135, 1140, 1145, 1150, 1155, 1160, 1165, 1170, 1175, 1180, 1185, 1190, and 1195 are also configured to support the biasing assembly 1300, as also shown in FIGS. 2 and 4.

Each of these mounting brackets includes a base portion (not labeled) and a receiver portion (not labeled) integrally connected to the respective base portion. For example, as shown in FIGS. 16, 17, 18, and 19, mounting bracket 1145 includes a base portion 1146 and a receiver portion 1147 integrally connected to the base portion 1146. Each base portion is fixedly connected to the curved panel 30 of the roof 28. Each receiver portion is configured to receive and be journaled about a portion of the hatch cover engager rotator 1200. In this illustrated example embodiment, each receiver portion includes a hollow cylindrical member through which part of the hatch cover engager rotator 1200 extends and which supports that part of the hatch cover engager rotator 1200. Each of the mounting brackets pivot arm is made of steel in this example embodiment. It should be appreciated that any of the mounting brackets can be alternatively sized, configured, and made of different materials in accordance with the present disclosure.

The hatch cover engager rotator 1200 includes a plurality of elongated cylindrical rods that are not individually labeled and a plurality of rod connectors that are not individually labeled. For example, as shown in FIGS. 16 and 19, the rods 1216 and 1218 are suitably connected by rod connecter 1217. The rod connectors suitably connect the rods to form the hatch cover engager rotator 1200. It should be appreciated that any suitable quantity of rods and rod connectors can be employed in accordance with the present disclosure. The hatch cover engager rotator is made of steel in this example embodiment. It should be appreciated that the hatch cover engager rotator can be alternatively sized, configured, and made of different materials in accordance with the present disclosure.

Generally, in the first position, the hatch cover engager rotator 1200 causes the hatch cover engager 1400 to engage the hatch 200, the hinges 300*a*, 300*b*, 300*c*, 300*d*, 300*e*, and 300*f*, and the hinges 400 and 500 at various spaced apart positions along the hatch cover 150 to secure the hatch cover 150 in the closed position and to secure the hatch cover 150 and specifically the hatch 200 to the coaming 40 (as shown in FIGS. 2, 3, 6, and 11). The hatch cover engager rotator 1200 is biased toward the first position by the biasing assembly 1300. Generally, in the second position, the hatch cover engager rotator 1200 causes the hatch cover engager 1400 to be dis-engaged from the hatch cover 150 and out of the way of the hatch cover 150 to allow parts of the hatch cover 150 (and specifically the hatch 200 and the arms of the hinges 300*a*, 300*b*, 330*c*, 300*d*, 300*e*, and 300*f* of the hatch cover 150) to move from the closed position to a fully opened position (shown in FIGS. 4, 5, 10, and 15).

The biasing assembly 1300 includes one or more biasing members such as biasing members 1310, 1340, and 1370 suitably connected to the hatch cover engager rotator 1200 and particularly to one or more of the rods of the hatch cover engager rotator 1200. The biasing members 1310, 1340, and 1370 in this example embodiment each include a torsion spring. The biasing members 1310, 1340, and 1370 are configured to bias the hatch cover engager rotator 1200 and the hatch cover engager 1400 toward the first position. If the hopper railroad car or the top hatch cover assembly 100 loses power, the biasing members 1310, 1340, and 1370 are configured to cause the hatch cover engager rotator 1200 to rotate toward the first position such that the hatch cover engager 1400 can secure the hatch cover 150 to the coaming 40 even if the hopper railroad car or the hatch cover assembly 100 loses power. The biasing assembly is made of steel in this example embodiment. It should be appreciated that the biasing assembly can be alternatively sized, configured, and made of different materials in accordance with the present disclosure.

The hatch cover engager 1400 includes: (1) a plurality of engager supporting arms 1402, 1404, 1406, 1408, 1410, 1412, 1414, 1416, 1418, 1420, 1422, 1424, 1426, and 1428; (2) a plurality of elongated first hatch engagers 1432, 1434, 1436, 1438, 1440, 1442, and 1444; and (3) a plurality of second hatch engagers 1462 (not labeled), 1464 (not labeled), 1466 (not labeled), 1468, 1470, 1472 (not labeled), 1474 (not labeled), 1476 (not labeled), 1478 (not labeled), 1480 (not labeled), 1482 (not labeled), 1484 (not labeled), 1486 (not labeled), and 1488.

The plurality of engager supporting arms 1402, 1404, 1406, 1408, 1410, 1412, 1414, 1416, 1418, 1420, 1422, 1426, and 1428 are respectively fixedly connected to the rods of the hatch cover engager rotator 1200 and extend from such rods. The supporting arms are made of steel in this example embodiment. It should be appreciated that the supporting arms can be alternatively sized, configured, and made of different materials in accordance with the present disclosure. FIGS. 5-10 and 16-19 illustrate a first embodiment of the engager supporting arms 1402-1428, which are described above and below with respect to FIGS. 5-10 and 16-19. In an alternative embodiment, described below with respect to FIGS. 20-22, the engager supporting arms can be different.

The plurality of first elongated hatch engagers 1432, 1434, 1436, 1438, 1440, 1442, and 1444, are respectively suitably connected to the plurality of engager supporting arms 1402, 1404, 1406, 1408, 1410, 1412, 1414, 1416, 1418, 1420. Each first hatch cover engager is an elongated member suitably connected to and between two of the respective supporting arms. Specifically, (1) hatch engager 1432 extends between and is suitably connected to engager supporting arms 1402 and 1404; (2) hatch engager 1434 extends between and is suitably connected to engager supporting arms 1406 and 1408; (3) hatch engager 1436 extends between and is connected to engager supporting arms 1410 and 1412; (4) hatch engager 1438 extends between and is suitably connected to engager supporting arms 1414 and 1416; (5) hatch engager 1440 extends between and is suitably connected to engager supporting arms 1418 and 1420; (6) hatch engager 1442 extends between and is suitably connected to engager supporting arms 1422 and 1424; and (7) hatch engager 1444 extends between and is suitably connected to engager supporting arms 1426 and 1428. As best shown in FIGS. 16, 18, and 19, for example, the hatch cover engager 1434 is suitably connected at one end to supporting arm 1408 and the hatch cover engager 1434 is suitably connected at one end to supporting arm 1410. Each elongated first hatch engager is configured to engage a portion of the top surface of the hatch 200 over a section of the hatch 200 that includes the seal 250 to thus apply pressure to that portion of the hatch 200 and that portion of the seal 250. The first elongated hatch engagers are made of steel in this example embodiment. It should be appreciated that the first elongated hatch engagers can be alternatively sized, configured, and made of different materials in accordance with the present disclosure.

The plurality of second hatch cover engagers 1462, 1464, 1466, 1468, 1470, 1472, 1474, 1476, 1478, 1480, 1482, 1484, 1486, and 1488, are respectively suitably connected to the plurality of engager supporting arms 1402, 1404, 1406, 1408, 1410, 1412, 1414, 1416, 1418, 1420, 1422, 1424, 1426, and 1428. Each second hatch cover engager is an L-shaped member connected to one of the supporting arms. Specifically, (1) hatch cover engager 1462 is suitably connected to and extends from engager supporting arm 1402; (2) hatch cover engager 1464 is suitably connected to and extends from engager supporting arm 1404; (3) hatch cover engager 1466 is suitably connected to and extends from engager supporting arm 1406; (4) hatch cover engager 1468 is suitably connected to and extends from engager supporting arm 1408; (5) hatch cover engager 1470 is suitably connected to and extends from engager supporting arm 1410; (6) hatch cover engager 1472 is suitably connected to and extends from engager supporting arm 1412; and (7) hatch cover engager 1474 is suitably connected to and extends from engager supporting arm 1414; (8) hatch cover engager 1476 is suitably connected to and extends from engager supporting arm 1416; (9) hatch cover engager 1478 is suitably connected to and extends from engager supporting arm 1418; (10) hatch cover engager 1480 is suitably connected to and extends from engager supporting arm 1420; (11) hatch cover engager 1482 is suitably connected to and extends from engager supporting arm 1422; (12) hatch cover engager 1484 is suitably connected to and extends from engager supporting arm 1424; (13) hatch cover engager 1486 is suitably connected to and extends from engager supporting arm 1426; and (15) hatch cover engager 1488 is suitably connected to and extends from engager supporting arm 1428. As best shown in FIGS. 16, 18, and 19, for example, the hatch cover engager 1468 is suitably connected to supporting arm 1408, and the hatch cover engager 1470 is suitably connected to supporting arm 1410. Each second hatch cover engager is configured to engage the top surface of the one of the pivot arms of a respective one of the hinges 300*a*, 300*b*, 300*c*, 300*d*, 300*e*, 300*f*, 400, or 500. For example, as indicted by FIGS. 16, 18, and 19, the hatch cover engager 1468 is configured to engage the top surface of the elongated hatch connector base 342*b* of pivot arm 340*b* on one side of the elongated support wall 344*b*, and the hatch cover engager 1470 is configured to engage the top surface of the elongated hatch connector base 342*b* of pivot arm 340*b* on the opposite side of the elongated support wall 344*b*. Each second hatch cover engager is configured to engage the hinges and to apply pressure to that portion of the hatch 200. The first hatch cover engagers respectively engage the hatch between respective sets of spaced apart second hatch engagers, and thus the first hatch cover engagers and the second hatch cover engagers co-act to secure the hatch 200 in the closed position. The second hatch cover engagers are made of steel in this example embodiment. It should be appreciated that the second hatch cover engagers can be alternatively sized, configured, and made of different materials in accordance with the present disclosure.

Collectively, these multiple spaced apart engagements enable the hatch cover securer 1000 to selectively secure the hatch 200 of the hatch cover 150 in place engaging the coaming 40.

As mentioned above, and as best shown in FIGS. 6, 7, 8, 9, 10, 11, 12, 13, 14, and 15, the hatch cover assembly 100 includes (1) the first multi-action actuator 600 connected at a first end of the hopper railroad car 10 to both the first end hinge 400 and the hatch cover securer 1000, and (2) a second multi-action actuator 700 connected to a second end of the hopper railroad car 10 to both the second end hinge 500 and the hatch cover securer 1000.

More specially, in this illustrated example embodiment, each of the multi-action actuators 600 and 700 are mirrored images of each other, and thus actuator 700 is primarily discussed in detail for brevity. It should be appreciated that the multi-action actuators 600 and 700 do not need be mirror images of each other in accordance with the present disclosure.

The second multi-action actuator 700 generally includes: (1) a first mounting bracket assembly 710; (2) a kickstand 720; (3) a second mounting bracket assembly 730; (4) a kicker 752; and (5) a powered cylinder assembly 760 including a base end 762, an extendable movable rod 764, and a piston housing 766.

The first mounting bracket assembly 710 is suitably connected to the curved panel 30 of the roof 28 adjacent the coaming 40. The first mounting bracket assembly includes: (1) a mounting base 712; (2) a first mounting leg 714; (3) a second mounting leg 716; and (4) an actuator linkage assembly 718. The second mounting leg 716 is aligned with and spaced apart from the first mounting leg 714. The mounting base 712, the first mounting leg 714, and the second mounting leg 716 are suitably connected to the roof 28 and specifically to the curved panel 30 of the roof 28 adjacent to the coaming 40 as best shown in FIGS. 6, 7, 8, 9, and 10. The actuator linkage assembly 718 is suitably connected to the base end 762 of the powered cylinder assembly 760, and to the hatch cover engager rotator 1200. Movement of the base end 762 of the powered cylinder assembly 760 (e.g., due to extension of the extendable movable rod 764 in a first direction), causes the hatch cover engager rotator 1200 to rotate from the first position (i.e., the fully locked position described above and shown in FIG. 11) to the second position (i.e., the fully unlocked position described above and shown in FIGS. 13, 14, and 15). The powered cylinder assembly 760 can be oriented generally parallel to a top of the roof 28 when the hatch cover assembly 100 is in the closed and locked position. However, it should be appreciated that in other examples, the powered cylinder assembly 760 is oriented at an angle of between 0 and 45 degrees from horizontal. Orientation at an angle can assist in increasing the mechanical advantage of the powered cylinder assembly 760, while minimizing exposure of the mechanism to railroad plate restrictions regarding maximum allowable height The powered cylinder assembly 760 is configured to receive suitable control signals or instructions from a suitable controller (not shown) via any suitable manner. It should be appreciated that these signals or instructions can be sent and received via any suitable manner. The powered cylinder assembly 760 of the second multi-action actuator 700 can be pneumatically powered, hydraulically powered, or electrically powered in various different embodiments. It should be appreciated that the powered cylinder assembly 760 can be any suitable such assembly.

The second multi-action actuator 700 provides forces to rotate the hatch cover engager rotator 1200 and the hatch cover engager 1400 suitably connected to the hatch cover engager rotator 1200 to move the hatch cover engager 1400 from the hatch cover engagement position (i.e., fully locked) to the hatch cover non-engagement position (i.e., fully unlocked), and vice versa. In the illustrated embodiment, each of the first and second multi-action actuators 600 and 700 are positioned adjacent to the first and second ends of the hatch cover engager rotator 1200.

Each multi-action actuator 600 and 700 is suitably connected to the curved panel 30 of the roof 28 via respective first and second mounting bracket assemblies, and one or more fasteners, welds, or other connection mechanisms (not labeled) in accordance with the present disclosure.

Figure 12:
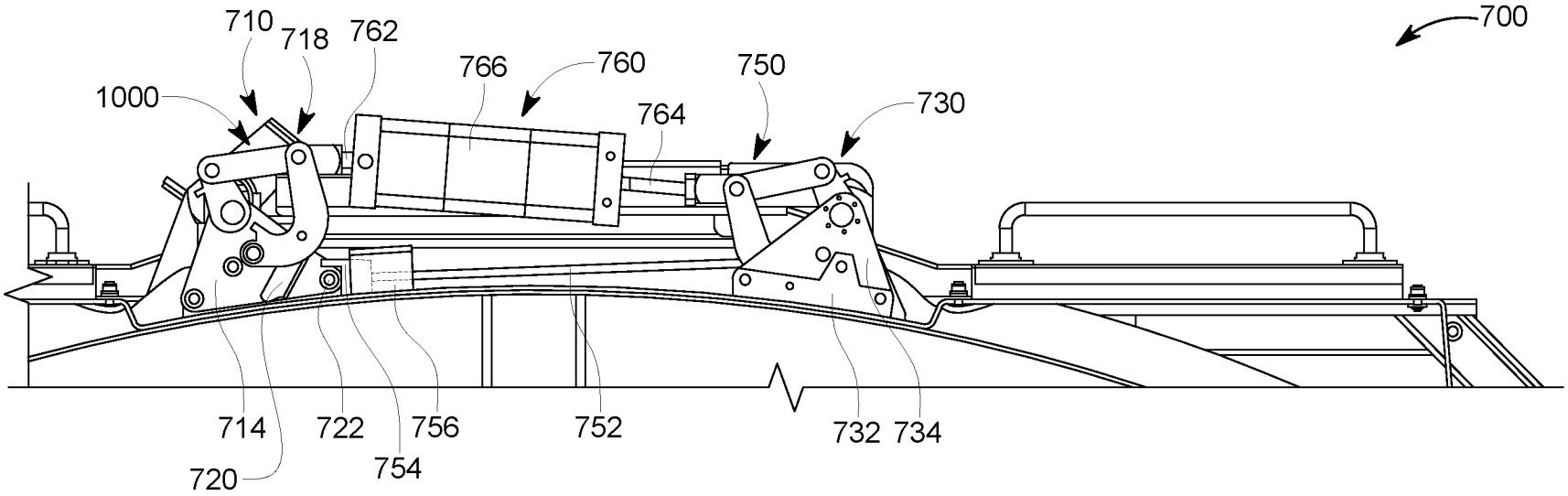
FIG. 12 is an enlarged fragmentary end view of the second end of the roof of the example hopper railroad car of FIG. 1, and the second end of the top hatch cover assembly of FIG. 2 shown connected to the second end of the roof of the hopper railroad car of FIG. 1 and shown in partially unlocked and fully closed position.
Figure 13:
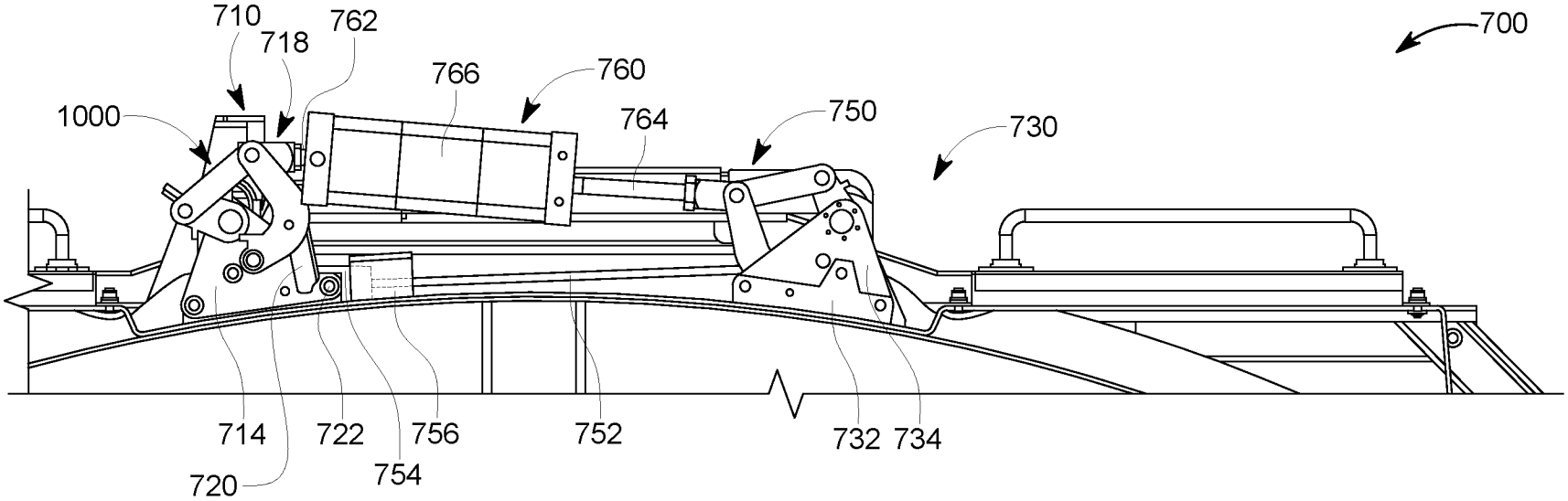
FIG. 13 is an enlarged fragmentary end view of the second end of the roof of the example hopper railroad car of FIG. 1, and the second end of the top hatch cover assembly of FIG. 2 shown connected to the second end of the roof of the hopper railroad car of FIG. 1 and shown in a fully unlocked and fully closed position.
Figure 14:
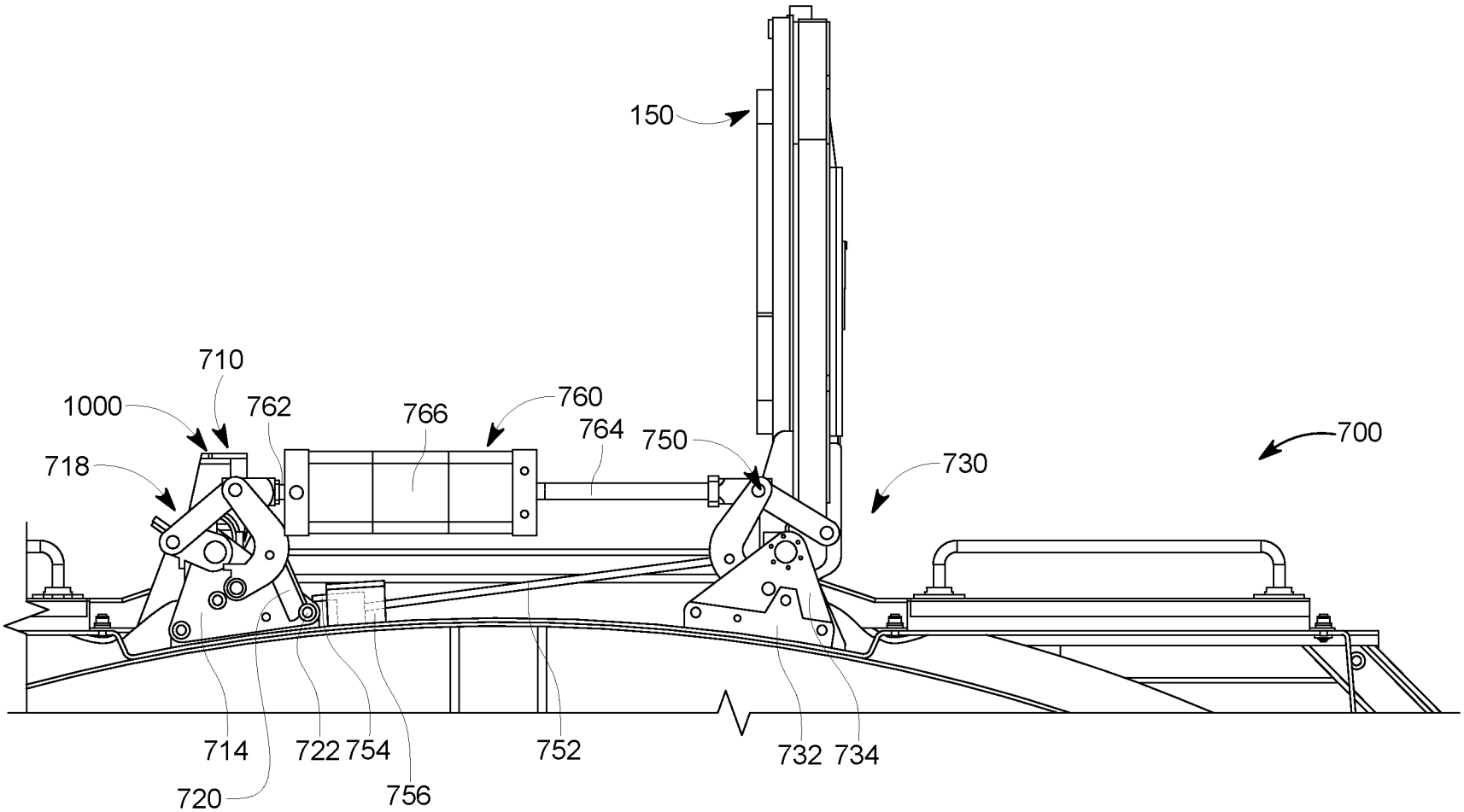
FIG. 14 is an enlarged fragmentary end view of the second end of the roof of the example hopper railroad car of FIG.

The kickstand 720, best illustrated in FIGS. 11, 12, 13, 14, and 15, operates to lock the second multi-action actuator 700 in the fully unlocked position under certain circumstances. The kickstand 720 can be spring-loaded, and pivotably attached to the actuator linkage assembly 718, such that movement of the actuator linkage assembly 718 causes movement of the kickstand 720 and vice versa. When the actuator linkage assembly 718 transitions from the fully locked position (shown in FIG. 11) to the fully unlocked position wherein the hatch 150 is partially open (shown in FIG. 14) and through the intermediate stages shown in FIGS. 12 and 13), the kickstand pivots to engage the locking pin 722. As shown best in FIG. 11, the kickstand 720 can include a first end pivotably connected to the actuator linkage assembly 718, and a second end opposite the first end that has a curved surface (not labeled). The curved surface of the kickstand 720 is configured to rest on and engage the locking pin 722. The locking pin 722 can be attached to the mounting base 712 of the first mounting bracket assembly 710. When the kickstand 720 is engaged with the locking pin 722 (as shown in FIGS. 14, and 15) in the fully unlocked position, the actuator linkage assembly 718 is prevented from moving back to the unlocked position. The kickstand 720 prevents the actuator linkage assembly 718 from rotating, and thereby also prevents the hatch cover engager rotator 1200 of the hatch cover securer 1000 from rotating while the hatch cover 150 is in the open position. While the Figures illustrate locking pin 722 as a cylindrical pin, it should be appreciated that another mechanism can be used to perform the same or a similar function. For example, the pin can instead be a shoulder, an edge, a shelf, or another mechanism that is configured to hold the kickstand 720 in place until acted upon by the kicker 752. As will be described in more detail below, the kickstand 720 operates along with the powered cylinder assembly 760 and the kicker 752 to enable the ordered series of events shown in FIGS. 11-15 that includes first unlocking, and then opening the hatch 200, and in the reverse order which includes first closing the hatch 200, and then locking the hatch 200.

The second mounting bracket assembly 730 of the second multi-action actuator 700 includes: (1) a mounting base 732; (2) a first mounting leg 734; and (3) a second mounting leg 736. The second mounting leg 736 is aligned with and spaced apart from the first mounting leg 734. The mounting base 732, the first mounting leg 734, and the second mounting leg 736 are suitably connected to the roof 28 and specifically to the curved panel 30 of the roof 28 adjacent to the coaming 40 as best shown in FIGS. 6, 7, and 8. The second mounting bracket assembly 730 further includes: (4) a first mounting arm 738 integrally connected to and extending from the hinge plate 580; and (5) a second mounting arm 740 integrally connected to and extending from the hinge plate 580. The second mounting arm 740 is aligned with and spaced apart from the first mounting arm 738. The first mounting leg 734, the second mounting leg 736, the first mounting arm 738, and the second mounting arm 740 define aligned openings (not shown or labeled) for receiving part of a pivot pin assembly 741. The second mounting bracket assembly 730 is made of steel in this example embodiment. It should be appreciated that the second mounting bracket assembly 730 can be alternatively sized, configured, and made of different materials in accordance with the present disclosure.

The first mounting arm 738 and the second mounting arm 740 are pivotally mounted to the first mounting leg 734 and the second mounting leg 736 by the pivot pin assembly 741 to facilitate a suitable amount of clearance for pivoting and rotation of the first mounting arm 738 and the second mounting arm 740 relative to the roof 28 and specifically the curved panel 30 of the roof 28 as well as the coaming 40 of the roof 28. A solid shaft (not labeled) extends through first mounting leg 734, the four bar linkage (not labeled), the second mounting leg 736, the first mounting arm 738, the hollow tube 742, and the second mounting arm 740. The hollow tube 742 is fixedly attached to arms 738 and 740. The solid shaft is fixedly attached to the hollow tube 742 and arms 738 and 740 using bolts that pass through the holes in the hollow tube 742 and holes in the solid shaft. When the four bar linkage is actuated, it rotates the solid shaft, which rotates the hollow tube 742 and arms 738 and 740, causing hinge plate 780 to rotate.

It should be appreciated that the actuator linkage assembly 750 is suitably fixedly connected to the pivot pin assembly 741 such that actuation of the extendable rod 764 of the second multi-action actuator 700 causes the actuator linkage assembly 750 to rotate parts of the actuator linkage assembly 750, which rotate the first mounting arm 738 and the second mounting arm 740, which rotate the pivot arm 560 and the hinge plate 580, which causes the hatch 200 to move from the closed position to the fully open position.

It should be appreciated that the actuator linkage assembly 750 can include any suitable linkages and connectors that are arranged such that extension of the extendable rod 764 of the second multi-action actuator 700 causes pivot pin assembly 741 to rotate relative to the first mounting leg 734 and the second mounting leg 736. The actuator linkage assembly 750 is made of steel in this example embodiment. It should be appreciated that the actuator linkage assembly 750 can be alternatively sized, configured, and made of different materials in accordance with the present disclosure.

The kicker 752, best illustrated in FIGS. 11, 12, 13, 14, and 15, operates to engage the kickstand 720 in certain circumstances. The kicker 752 is pivotably attached to the actuator linkage assembly 750, such that movement of the actuator linkage assembly 750 causes movement of the kicker 752 and vice versa. When the hatch 200 is in the fully open position (e.g., FIG. 15), the kicker 752 is disengaged from and spaced apart from the kickstand 720. When the hatch transitions to the closed position (e.g., moving from the positions shown in FIG. 15 to FIG. 14, and then from FIG. 14 to FIG. 13), the actuator linkage 750 also rotates, thereby causing the kicker 752 to move laterally toward the kickstand 720. At a certain point in the transition from a fully open hatch 200 to a fully closed hatch 200, the L-shaped end member 754 of the kicker 752 engages the face of the kickstand 720, and the kickstand 720 is pushed via rotation away from the locking pin 722. This enables the actuator linkage assembly 718 to no longer be "locked out," and enables the hatch cover engager rotator 1200 to rotate to the locked position. However, because the kicker 752 is attached to the actuator linkage assembly 750, the hatch 200 must be nearly in the closed position before the end member 754 of the kicker 752 engages the kickstand 720. This ensures that the hatch 200 is in or near the closed position before the actuator linkage assembly 718 and hatch cover engager rotator 1200 are able to rotate to the locked position. This arrangement of the kicker 752 and kickstand 720 prevents unintentionally rotating the hatch cover securer 1000 to the locked position if the hatch 200 is in the open position. The kicker 752 also include a kicker guide 756 attached to the top of the curved panel 30. The kicker guide 756 is configured to align the end member 754 of the kicker 752 with the kickstand 720 as the end member 754 translates back and forth. Further, the kicker guide 756 is configured to protect the end member 754 from interference caused by environmental impacts such as snow, ice, and debris.

As mentioned above, the multi-action actuators 600 and 700 co-act to provide forces to move and particularly to rotate the hatch cover securer 1000 from the locked position to the unlocked position and vice versa. The multi-action actuators 600 and 700 also co-act to provide forces to move and particularly to rotate the hatch 200 from the closed position to the fully open position, and vice versa.

In the illustrated embodiment, the multi-action actuators 600 and 700 are respectively positioned adjacent to the first and second ends of the hatch 200. The multi-action actuators 600 and 700 are configured to lock and unlock the hatch cover securer 1000 from either or both ends, and to open the hatch 200 from either or both ends. Each actuator can lift the respective end of the elongated movable flexible hatch 200 to cause a sequential lifting of the hatch 200 from the coaming 40 in sequential sections from that end. This process in effect causes an unpeeling of the hatch 200 from the coaming 40. Both multi-action actuators 600 and 700 can cause this to occur simultaneously from both ends of the hatch 200 such that the unpeeling effect meets in the middle of the hatch 200 and such that the central most section of the hatch 200 is the last section to be lifted (or unpeeled) from the coaming 40.

FIGS. 11, 12, 13, 14, and 15 further illustrate perspective end views of part of the operation of the second multi-action actuator 700, in particular a progression from a fully locked and fully closed position to a fully unlocked and fully open position.

Figure 11:
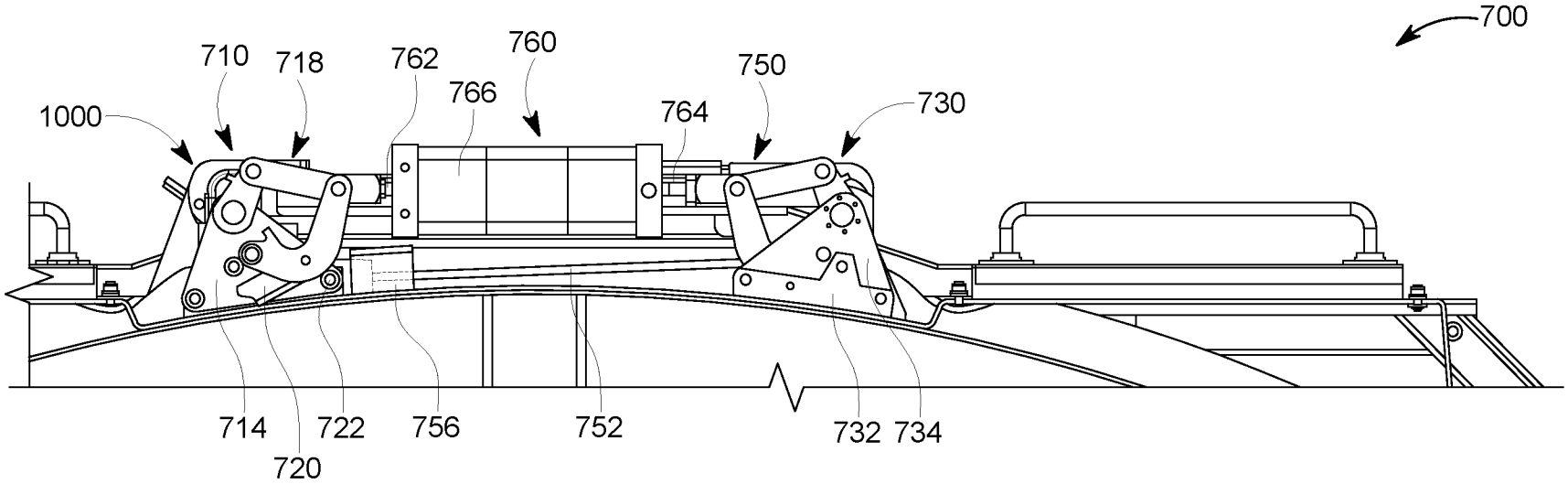
FIG. 11 is an enlarged fragmentary end view of the second end of the roof of the example hopper railroad car of FIG. 1, and the second end of the top hatch cover assembly of FIG. 2 shown connected to the second end of the roof of the hopper railroad car of FIG. 1 and shown in fully locked and fully closed position.

FIG. 11 illustrates the hatch cover in a closed position, obscured by the section multi-action actuator 700. In FIG. 11, the hatch cover 150 is positioned engaging the coaming 40 such that oval coaming sealer 250 engages (such as being positioned on the top of) and forms a seal with a suitable surface (such as the oval top surface) of the coaming 40. The coaming sealer 250 remains suitably connected to the steel coaming 40 by the force applied by the hatch cover securer 1000. It should be appreciated that the combination of: (1) the hinge 400; (2) the hinge 500; (3) the pivot arms of hinges **300*a* to 300*f*; (4) the additional hatch engagement members 350, 354, 358, 362, 366, 370, and 374; (5) the first elongated hatch engagers 1432, 1434, 1436, 1438, 1440, 1442, and 1444; and (6) the plurality of second hatch cover engagers 1462, 1464, 1466, 1468, 1470, 1472, 1474, 1476, 1478, 1480, 1482, 1484, 1486, and 1488, are individually and collectively configured to engage respective portions of the top surface of the hatch 200 over a section of the hatch 200 that includes the seal 250 to apply even amounts of pressure to those portions of the hatch 200 and those portions of the seal 250. In various embodiments, these components co-act to compress the seal under a desired amount of pressure at least point or section of the seal 250**. In various such embodiments, the amounts of pressure is even or substantially even over the entire lengths of both sides of the coaming and both ends of the coaming. In various such embodiments, the amounts of pressure are greater than 5 pounds per every 3 inches. In various embodiments, the biasing assembly maintains this pressure even if power is lost.

FIGS. 12 and 13 illustrate the hatch cover securer 1000 in a partially unlocked position and a fully unlocked position respectively, while the hatch cover 150 remains in the closed position. FIGS. 12 and 13 illustrate that the extendable movable rod 764 has been partially extended by a first amount in FIG. 12, and a second, greater amount in FIG. 13. This extension of the extendable rod 764 causes the base end 762 of the powered cylinder assembly 760 to move, which in turn causes movement of the actuator linkage assembly 718. Movement of the actuator linkage assembly 718 causes rotation of the hatch cover securer 1000 from the fully locked position shown in FIG. 11, to the partially unlocked position shown in FIG. 12, and then to the fully unlocked position shown in FIG. 13. This rotation of the hatch cover securer 1000 is a counterclockwise rotation as shown in the sequence from FIG. 11 to FIG. 12, and from FIG. 12 to FIG. 13.

FIG. 14 illustrates the hatch cover 150 in a partially open position. To open the hatch cover 150, the multi-action actuators 600 and 700 rotate the hatch cover engager rotator 1200 and the hatch cover engager 1400 of the hatch cover securer 1000 to move the hatch cover engager 1400 from the hatch cover engagement position to the hatch cover non-engagement position. The multi-action actuators 600 and 700 then rotate the hatch cover 150 causing it to move upwardly and away from the coaming 40 at that end. FIG. 14 shows the rotated hatch cover securer 1000, and the hatch cover 150 in a partially opened position.

FIG. 15 illustrates the hatch cover 150 in a fully open position. To move to the hatch cover 150 to the closed position, the process of FIGS. 11, 12, 13, 14, and 15 is reversed.

Unlocking and Opening the Hatch

When viewing FIGS. 11-15 in order, these Figures illustrate a process for unlocking and opening the hatch cover 150. Beginning with FIG. 11, it should be appreciated that the piston housing 766 is positioned generally horizontally, and the kickstand 720 is rotated out of engagement with the locking pin 722. A first step in unlocking the hatch includes extending the extendable rod 764 by a first amount. The powered cylinder assembly 760 is configured to rotate both the actuator linkage assembly 718 (via the base end 762 shown on the left in FIG. 11) and the actuator linkage assembly 750 (via the extendable rod 764 shown on the right in FIG. 11). The torque required to rotate the hatch cover securer 1000 coupled to the actuator linkage assembly 718 may be less than the torque required to rotate the hatch 200 coupled to the actuator linkage 750. Thus, the initial extension of the extendable rod 764 by the first amount may cause the actuator linkage 718 to rotate (while actuator linkage 750 remains stationary), thereby causing the hatch cover securer 1000 to rotate to the unlocked position. The initial extension of the extendable rod 764 causes the piston housing 766 to rotate, such that the base end 762 is higher, and the piston housing in no longer horizontal, as shown in FIGS. 12 and 13.

Once the extendable rod 764 has moved an additional amount and the hatch cover securer 1000 has fully rotated to the unlocked position (e.g., shown in FIG. 13), the extendable rod 764 continues to be extended. FIG. 14 illustrates that since the hatch cover securer 1000 is fully rotated, the actuator linkage assembly 718 is prevented from further rotation (e.g., further counter clockwise rotation as shown). As an effect of the actuator linkage assembly 718 being prevented from further rotation, further extension of the extendable rod 764 causes the actuator linkage assembly 750 to rotate, thereby beginning to open the hatch cover 150. As the actuator linkage assembly 750 begins to rotate, the end member 754 of the kicker 752 attached to the actuator linkage assembly 750 moves out of engagement with the kickstand 720. As a result, the kickstand 720 pivots into engagement with the locking pin 722, as shown in FIG. 14. FIG. 14 also illustrates that as the extendable rod is extended and the actuator linkage 750 rotates, the piston housing 766 rotates again such that it is again in a generally horizontal position. Then, as the extendable rod continues to be extended, the actuator linkage assembly 750 continues to rotate, which in turn causes the piston housing 766 to rotate out of a generally horizontal position. Additionally, further extension of the extendable rod 764 causes the hatch cover 150 to rotate into the open position as shown in FIG. 15.

The steps for unlocking and opening the hatch (i.e., proceeding forward from FIG. 11 to FIG. 15) include (1) extending the extendable rod 764 by a first amount; (2) extending the extendable rod 764 by the first amount causes the base end 762 of the powered cylinder assembly 760 to move (i.e., upward and to the left as shown in FIGS. 11-13); (3) movement of the base end 762 causes the hatch cover securer 1000 to rotate, thereby partially unlocking the hatch cover securer 1000; (4) extending the extendable rod by a further amount causes the base end 762 of the powered cylinder assembly 760 to continue to move, and to fully rotate and fully unlock the hatch cover securer 1000 (i.e., FIG. 13); (5) further extending the extendable rod 764 cannot further rotate the hatch cover securer 1000, and thus further extending the extendable rod 764 causes the actuator linkage assembly 750 to move, thereby causing the movable hatch 200 to begin to open; (6) movement of the actuator linkage assembly 750 causes the end member 754 of the kicker 752 to move laterally out of engagement with the kickstand 720; (7) when the end member 754 of the kicker 752 moves laterally out of engagement, the kickstand is pivoted into engagement with the locking pin 722, preventing the hatch cover securer from closing; and (8) further extending the extendable rod 764, which causes the movable hatch 200 to move to the fully open position.

When viewing FIGS. 11-15 in reverse order, these Figures illustrate a process for closing and locking the hatch cover 150. Beginning with FIG. 15, it should be appreciated that the extendable rod 764 is fully extended, and the kickstand 720 is engaged with the locking pin 722, preventing the actuator linkage assembly 718 (and hatch cover securer 1000) from rotating clockwise. A first step in closing the hatch cover 150 includes retracting the extendable rod 764 by a first amount. As shown in FIG. 15, the piston housing 766 is rotated out of generally horizontal alignment. When the hatch cover rotates to the partially closed position as shown in FIG. 14, the piston housing 766 rotates to a generally horizontal position. In the position shown in FIG. 15, the torque required to rotate the hatch cover 150 may still be greater than the torque required to rotate the hatch cover securer 1000. Thus, without the inclusion of the kickstand 722, retracting the extendable rod 764 at this point may cause the hatch cover securer 1000 to rotate instead of the hatch cover 150 itself. However, the position of the kickstand 720 engaged with the locking pin 722 as shown in FIG. 15 prevents the hatch cover securer 1000 from rotating clockwise. This enables the retraction of the extendable rod 764 to cause the hatch cover 150 to rotate from the open position to the closed position.

When the extendable rod 764 is retracted a sufficient amount such that the hatch cover is nearly closed as shown in FIG. 13, the end member 754 of the kicker 752 is moved into engagement with the kickstand 720. As shown in FIG. 13, the end member 754 of the kicker 752 engages the kickstand 720, pushing the kickstand 720 off of the locking pin 722. Then, when the extendable rod 764 is further retracted into the piston housing 766 (e.g., transitioning from FIG. 13 to FIG. 12), actuator linkage 718 and hatch cover securer 1000 are configured to rotate clockwise. In the position shown in FIGS. 13, 12, and 11, actuator linkage 750 remains stationary because the hatch 150 is fully closed and cannot rotate any further. Thus, further retraction of the extendable rod 764 causes the hatch cover securer 1000 to rotate and lock the hatch cover 150. It should also be noted that the transition from the respective positions shown in FIGS. 13 to 12 to 11 causes the piston housing 766 to rotate such that it is in a generally horizontal position.

The steps for closing and locking the hatch (i.e., proceeding backward from FIG. 15 to FIG. 11) include: (1) retracting the extendable rod 764; (2) retracting the extendable rod 764 causing the actuator linkage assembly 750 to move and thereby causing the hatch cover 150 to rotate counterclockwise to a partially closed position; (3) further retracting the extendable rod 764 until the actuator linkage assembly 750 and hatch cover 150 are in a fully closed position; (4) rotating the actuator linkage assembly 750 to the fully closed position causing the kicker 752 to move laterally into engagement with the kickstand 720; (5) moving of the kicker 752 into engagement with the kickstand 720 to push the kickstand 720 off the locking pin 722; (6) further retracting the extendable rod 764 causing the actuator linkage assembly 718 and the hatch cover securer 1000 to rotate clockwise into a partially locked position (e.g., as shown in FIG. 12); and (7) the further retracting the extendable rod causing the actuator linkage 718 and hatch cover securer 1000 to rotate to the locked position. As indicated above, the process is reversed to open the hatch 200.

Turning now to FIGS. 20, 21, and 22, a second embodiment of the engager supporting arms 1402-1428 is shown, which may be referred to as an icebreaker assembly. In this second embodiment, the engager supporting arms can function in a manner similar or identical to the first embodiment, in addition to operating to engage the hatch cover 150 during the process of unlocking the hatch cover securer 1000. This enables the hatch cover assembly to overcome the effects of ice buildup between the movable hatch 200 and the combing 40 that causes the movable hatch 200 to be temporarily stuck in the closed position. The second embodiment of the engager supporting arms 1402-1428 are illustrated as engager supporting arms 1402A-1428A in FIGS. 20-22. The hatch cover assembly can include a plurality of engager supporting arms 1402A-1428A spaced apart along the length of the hatch cover. Each of the engager supporting arms 1402A-1428A can be similar or identical to each other, so for the sake of brevity only engager supporting arm 1408A is described in detail. Engager supporting arm 1408A includes: (1) a transverse plate 1408A-1, (2) an icebreaker mounting assembly 1408A-2, and (3) a hatch lifter 1408A-3.

The transverse plate 1408A-1 defines a rod aperture 1408A-4, through which one of the rods of the hatch cover engager rotator 1200 are configured to pass. The transverse plate 1408A-1 also defines one or more fastening apertures, which are configured to receive fasteners. The transverse plate 1408A-1 is affixed to the icebreaker mounting assembly 1408A-2, such as by one or more fasteners. In other examples, the transverse plate 1408A-1 can be affixed to the icebreaker mounting assembly 1408A-2 by welding or another attachment mechanism.

The icebreaker mounting assembly 1408A-2 is configured to engage one of the elongated first hatch engagers of the hatch cover engager 1400. As shown in FIGS. 20, 21, and 22, the icebreaker mounting assembly 1408A-2 is affixed to elongated first hatch engager 1434.

The hatch lifter 1408A-3 extends generally perpendicular to the transverse plate 1408A-1, to provide a greater surface area with which to engage the hatch cover 200. It should be appreciated that in some examples, the hatch lifter 1408A-3 can be affixed to the transverse plate 1408A-1 via one or more fastening members or welds, while in other examples the hatch lifter can be a part of the transverse plate 1408A-1 that has been bent or formed such that it extends generally perpendicular or transverse to the transverse plate 1408A-1.

FIGS. 21 and 22 illustrate the engager supporting arm 1408A when the hatch cover securer 1000 is in the locked position and when the hatch cover securer 1000 is in the partially unlocked position. When the hatch cover 200 is fully closed, and the hatch cover securer 1000 is in the fully locked position, the hatch cover engager 1400 is configured to apply downward pressure on the top of the hatch cover 200, as discussed above. When it is desired to unlock and open the hatch cover 200, the hatch cover securer 1000 is rotated via the first and/or second multi-action actuators 600 and 700. Rotation of the hatch cover securer 1000 causes the engager supporting arm 1408A to also rotate, thereby bringing the hatch lifter 1408A-3 into contact with the hatch cover 200. In the illustrated embodiment, the hatch lifter 1408A-3 contacts the underside of the hatch cover 200 proximate the contact point between the elongated combing sealer 250 and the coaming 40. This contact between the hatch lifter 1408A-3 and the hatch cover 200 causes any ice or other materials that have built up to become disengaged, and enables the hatch cover 200 to be more easily moved from the closed position to the open position.

Certain embodiments include multiple engager supporting arms configured to function as icebreakers spaced apart along the length of the hatch cover 200. For instance, engager supporting arms 1402A-1428A can be positioned near each of the second hatch engagers 1462, 1464, 1466, 1468, 1470, 1472, 1474, 1476, 1478, 1480, 1482, 1484, 1486, and 1488, such that each second hatch engager has a corresponding engager supporting arm. In other examples, more or fewer engager supporting arms that function as icebreakers can be employed.

Figure 10:
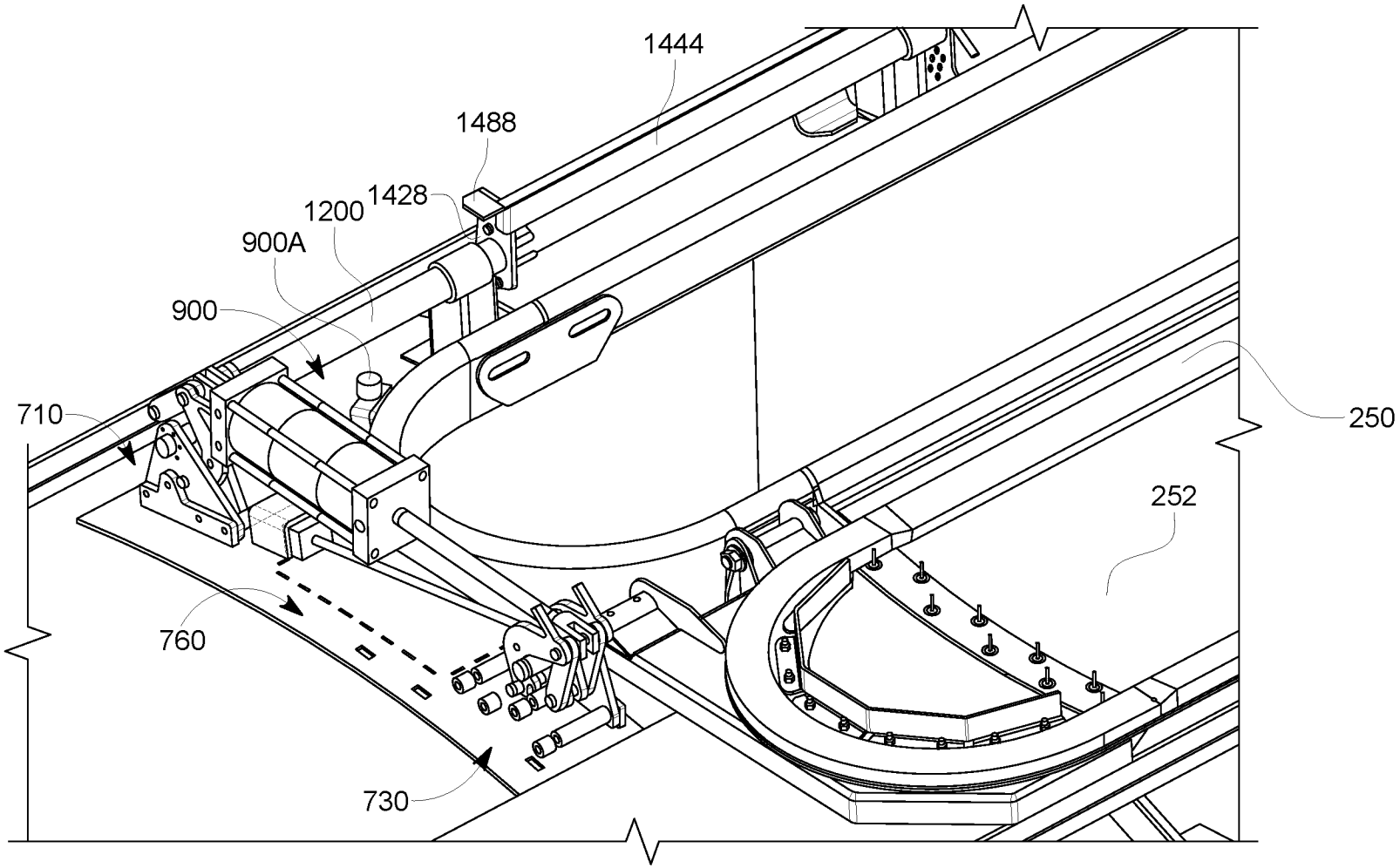
FIG. 10 is a further enlarged fragmentary top perspective view of the second end of the roof of the example hopper railroad car of FIG. 1, and the second end of the top hatch cover assembly of FIG. 2 shown connected to the second end of the roof of the hopper railroad car of FIG. 1 and shown in a fully open position.

It should be appreciated that the present disclosure contemplates adding bumpers such as bumper 900 shown in FIG. 10 for supporting the hinges 400 and 500. Such bumpers can include one or more rubber compressible bumper members such as member 900A.

In alternative embodiments of the present disclosure, one or more of the hinges can include a pivot assembly with a torsion shaft to synchronize or link the movement of some or all of the pivot arms.

It should be appreciated from the above that the present disclosure contemplates that the hatch cover can extend outwardly of the coaming to provide drip edges outwardly of the coaming.

It will be understood that modifications and variations may be effected without departing from the scope of the novel concepts of the present invention, and it is understood that this application is to be limited only by the scope of the claims.

The invention claimed is:

1. A hopper railroad car top hatch cover assembly for a hopper railroad car including a roof including an upwardly extending coaming, the hopper railroad car hatch cover assembly comprising:

a hatch cover pivotally connectable on one side of the coaming and including a movable hatch pivotally movable from a closed position engaging the coaming to an open position disengaged from the coaming;

a hatch cover securer movably connectable on an opposite side of the coaming and including a hatch cover engager movable from a hatch cover engagement position in which the hatch cover engager secures the movable hatch in the closed position engaging the coaming to a hatch cover non-engagement position in which the hatch cover engager allows the movable hatch to move to the open position; and a multi-action actuator positioned at a first end of the coaming, the multi-action actuator comprising:

a first mounting bracket assembly connectable to the hatch cover securer and positioned to move the hatch cover engager between the hatch cover engagement position and the hatch cover non-engagement position;

a second mounting bracket assembly connectable to the hatch cover and positioned to move the movable hatch between the closed position and the open position; and a powered cylinder assembly having a first end and an opposite second end, the first end connectable to the first mounting bracket assembly and the second end connectable to the second mounting bracket assembly such that the powered cylinder assembly is between the first mounting bracket assembly and the second mounting bracket assembly, and such that the powered cylinder assembly is actuatable to cause movement of both the first mounting bracket assembly and the second mounting bracket assembly.

2. The hopper railroad car hatch cover assembly of claim 1, wherein the first mounting bracket assembly includes an actuator linkage assembly connectable to the first end of the powered cylinder assembly and the hatch cover securer to transfer movement of the powered cylinder assembly into rotation of the hatch cover securer.

3. The hopper railroad car hatch cover assembly of claim 1, wherein the second mounting bracket assembly includes an actuator linkage assembly connectable to the second end of the powered cylinder assembly and the hatch cover to transfer movement of the powered cylinder assembly into rotation of the hatch cover.

4. The hopper railroad car hatch cover assembly of claim 1, wherein the powered cylinder assembly is positioned to sequentially actuate (1) the first mounting bracket assembly to cause the hatch cover securer to move the hatch cover engager from the hatch cover engagement position to the hatch cover non-engagement position, and (2) the second mounting bracket assembly to cause the movable hatch to move from the closed position to the open position.

5. The hopper railroad car hatch cover assembly of claim 1, wherein the multi-action actuator is a first multi-action actuator, and wherein the hopper railroad car hatch cover assembly includes a second multi-action actuator positioned at a second end of the coaming opposite the first multi-action actuator, the second multi-action actuator including a first mounting bracket assembly, a second mounting bracket assembly, and a powered cylinder assembly actuatable to cause movement of both of said first mounting bracket assembly and said second mounting bracket assembly of said second multi-action actuator.

6. A hopper railroad car top hatch cover assembly for a hopper railroad car including a roof including an upwardly extending coaming, the hopper railroad car hatch cover assembly comprising:

a hatch cover pivotally connectable on one side of the coaming and including a movable hatch pivotally movable from a closed position engaging the coaming to an open position disengaged from the coaming;

a hatch cover securer movably connectable on an opposite side of the coaming and including a hatch cover engager movable from a hatch cover engagement position in which the hatch cover engager secures the movable hatch in the closed position engaging the coaming to a hatch cover non-engagement position in which the hatch cover engager allows the movable hatch to move to the open position; and a multi-action actuator positioned at a first end of the coaming, the multi-action actuator comprising:

a first mounting bracket assembly connectable to the hatch cover securer, the first mounting bracket assembly including a kickstand movable between a kickstand engagement position and a kickstand non-engagement position, the kickstand configured to prevent movement of the first mounting bracket assembly when the kickstand is in the kickstand engagement position; and a second mounting bracket assembly connectable to the hatch cover, the second mounting bracket assembly including a kicker movable between a kicker engagement position and a kicker non-engagement position, the kicker configured to move the kickstand from the kickstand engagement position to the kickstand non-engagement position.

7. The hopper railroad car hatch cover assembly of claim 6, wherein the multi-action actuator includes a powered cylinder assembly connectable to both the first mounting bracket assembly and the second mounting bracket assembly, and configured to actuate to cause movement of both the first mounting bracket assembly and the second mounting bracket assembly.

8. The hopper railroad car hatch cover assembly of claim 6, wherein the kickstand is configured to prevent the hatch cover securer from moving from the hatch cover non-engagement position to the hatch cover engagement position when the kickstand is in the kickstand engagement position.

9. The hopper railroad car hatch cover assembly of claim 6, wherein the kickstand is biased toward the kickstand engagement position.

10. The hopper railroad car hatch cover assembly of claim 6, wherein the first mounting bracket assembly includes a locking pin, and wherein the kickstand is engageable with the locking pin when the kickstand is in the kickstand engagement position.

11. The hopper railroad car hatch cover assembly of claim 6, wherein movement of the first mounting bracket assembly in a first direction causes both (a) the hatch cover securer to move from the hatch cover engagement position to the hatch cover non-engagement position, and (b) the kickstand to move from the kickstand non-engagement position to the kickstand engagement position.

12. The hopper railroad car hatch cover assembly of claim 6, wherein movement of the second mounting bracket assembly in a first direction causes both: (a) the hatch cover to move from the open position to the closed position, and (b) the kicker to move from the kicker non-engagement position to the kicker engagement position.

13. The hopper railroad car hatch cover assembly of claim 12, wherein the kicker is engageable with the kickstand to move the kickstand from the kickstand engagement position to the kickstand non-engagement position when the kicker moves from the kicker non-engagement position to the kicker engagement position.

14. The hopper railroad car hatch cover assembly of claim 6, which includes a kicker guide configured to guide movement of the kicker between the kicker engagement position and the kicker non-engagement position.

15. A hopper railroad car top hatch cover assembly for a hopper railroad car including a roof including an upwardly extending coaming, the hopper railroad car hatch cover assembly comprising:

a hatch cover pivotally connectable on one side of the coaming and including a movable hatch pivotally movable from a closed position engaging the coaming to an open position disengaged from the coaming; and a hatch cover securer movably connectable on an opposite side of the coaming and including an icebreaker assembly moveable to provide a force to cause the movable hatch to move from the closed position toward the open position, and such that the icebreaker assembly is moveable from an icebreaker non-engagement position to an icebreaker engagement position when the hatch cover engager moves from the hatch cover engagement position to the hatch cover non-engagement position.

16. The hopper railroad car hatch cover assembly of claim 15, wherein the hatch cover securer includes a hatch cover engager movable from a hatch cover engagement position in which the hatch cover engager secures the movable hatch in the closed position engaging the coaming to a hatch cover non-engagement position in which the hatch cover engager allows the movable hatch to move to the open position.

17. The hopper railroad car hatch cover assembly of claim 16, which includes a multi-action actuator positioned at a first end of the coaming, the multi-action actuator configured to cause movement of both the hatch cover engager and the movable hatch.

18. The hopper railroad car hatch cover assembly of claim 15, wherein the icebreaker assembly is rotatable to provide the force to cause the movable hatch to move from the closed position toward the open position.

19. The hopper railroad car hatch cover assembly of claim 15, wherein the icebreaker assembly is engagable with an underside of the movable hatch.

20. The hopper railroad car hatch cover assembly of claim 15, wherein the hatch cover securer includes a plurality of spaced apart icebreaker assemblies.

* * * * *